US008968052B2

(12) United States Patent
Walsh et al.

(10) Patent No.: US 8,968,052 B2
(45) Date of Patent: Mar. 3, 2015

(54) SYSTEMS AND METHODS OF WAFER GRINDING

(71) Applicant: Strasbaugh, San Luis Obispo, CA (US)

(72) Inventors: Thomas A. Walsh, Atascadero, CA (US); Michael R. Vogtmann, Paso Robles, CA (US)

(73) Assignee: Strasbaugh, San Luis Obispo, CA (US)

( * ) Notice: Subject to any disclaimer, the term of this patent is extended or adjusted under 35 U.S.C. 154(b) by 217 days.

(21) Appl. No.: 13/656,514

(22) Filed: Oct. 19, 2012

(65) Prior Publication Data

US 2013/0102227 A1 Apr. 25, 2013

Related U.S. Application Data

(60) Provisional application No. 61/549,787, filed on Oct. 21, 2011, provisional application No. 61/585,643, filed on Jan. 11, 2012, provisional application No. 61/708,146, filed on Oct. 1, 2012, provisional (Continued)

(51) Int. Cl.
*B24B 7/04* (2006.01)
*B24B 37/013* (2012.01)

(52) U.S. Cl.
CPC ..... *B24B 37/013* (2013.01)
USPC ..... 451/11; 451/8; 451/10; 451/65; 451/403

(58) Field of Classification Search
CPC ..... B24B 7/04; B24B 7/228; B24B 27/0076; B24B 41/007; B24B 41/06; B23Q 16/06; B23Q 16/0065
USPC ..... 451/8, 10, 11, 65, 285–289, 390, 398, 451/397, 272, 276, 400, 403
See application file for complete search history.

(56) References Cited

U.S. PATENT DOCUMENTS 2,665,589 A * 1/1954 Rusher ..... 74/88
2,968,133 A * 1/1961 Reichardt ..... 451/275

(Continued)

FOREIGN PATENT DOCUMENTS

JP 2006120757 A * 5/2006
WO 2013/059705 A1 4/2013
WO 2013106777 7/2013

OTHER PUBLICATIONS

PCT; Notification of Transmittal of the International Search Report and the Written Opinion of the International Searching Authority issued in International Patent Application No. PCT/US2012/061169; Mailed Mar. 8, 2013; 2 Pages.

(Continued)

*Primary Examiner* — George Nguyen
(74) *Attorney, Agent, or Firm* — Fitch, Even, Tabin & Flannery LLP

(57) ABSTRACT

Systems and methods are provided for use in processing and/or grinding wafers or other work products. Some embodiments provide a grinding apparatus that comprise a base casting; a rotary indexer configured to rotate within the base casting; a work spindle secured with the rotary indexer; a work chuck coupled with the first work spindle, wherein the first work spindle is configured to rotate the first work chuck; a bridge casting secured relative to the base casting, wherein the bridge casting bridges across at least a portion of the rotary indexer and is supported structurally forming a closed stiffness loop; a grind spindle secured with the bridge casting; and a grind wheel cooperated with the grind spindle, wherein the bridge casting secures the grind spindle.

26 Claims, 21 Drawing Sheets

Related U.S. Application Data application No. 61/708,165, filed on Oct. 1, 2012, provisional application No. 61/632,262, filed on Jan. 23, 2012, provisional application No. 61/631,102, filed on Dec. 28, 2011.

(56) References Cited

U.S. PATENT DOCUMENTS

| | | | | |
|---|---|---|---|---|
| 3,142,942 | A * | 8/1964 | Celovsky | 451/292 |
| 3,885,925 | A * | 5/1975 | Tatar | 451/48 |
| 4,109,552 | A * | 8/1978 | Imoberdorf | 74/813 L |
| 5,718,619 | A * | 2/1998 | Merrill et al. | 451/41 |
| 5,964,646 | A | 10/1999 | Kassir et al. | |
| 6,254,155 | B1 | 7/2001 | Kassir | |
| 6,336,849 | B1 * | 1/2002 | Konnemann | 451/259 |
| 6,343,980 | B1 * | 2/2002 | Abe et al. | 451/292 |
| 6,386,956 | B1 * | 5/2002 | Sato et al. | 451/57 |
| 6,402,589 | B1 | 6/2002 | Inaba et al. | |
| 6,638,389 | B2 | 10/2003 | Kassir et al. | |
| 6,866,564 | B2 | 3/2005 | Strasbaugh et al. | |
| 6,976,901 | B1 | 12/2005 | Halley et al. | |
| 7,004,818 | B1 * | 2/2006 | Haney | 451/28 |
| 7,014,540 | B2 * | 3/2006 | Nagel | 451/57 |
| 7,018,268 | B2 | 3/2006 | Kassir et al. | |
| 7,022,000 | B2 | 4/2006 | Mizomoto et al. | |
| 7,059,942 | B2 | 6/2006 | Strasbaugh et al. | |
| 7,118,446 | B2 * | 10/2006 | Walsh et al. | 451/5 |
| 7,160,808 | B2 | 1/2007 | Kassir | |
| 7,458,878 | B2 | 12/2008 | Walsh et al. | |
| 8,133,093 | B2 | 3/2012 | Vogtmann et al. | |
| 8,520,222 | B2 | 8/2013 | Schraub et al. | |
| 2001/0002359 | A1 * | 5/2001 | Matsuo et al. | 451/285 |
| 2002/0006768 | A1 | 1/2002 | Wada et al. | |
| 2003/0124961 | A1 * | 7/2003 | Haney | 451/66 |
| 2003/0232581 | A1 | 12/2003 | Ki | |
| 2004/0011462 | A1 | 1/2004 | Gotkis et al. | |
| 2004/0063385 | A1 * | 4/2004 | Perlov et al. | 451/5 |
| 2005/0176350 | A1 | 8/2005 | Gerber | |
| 2007/0128983 | A1 | 6/2007 | Walsh et al. | |
| 2010/0285665 | A1 | 11/2010 | Takai et al. | |
| 2013/0130593 | A1 | 5/2013 | Kalenian et al. | |

OTHER PUBLICATIONS

PCT; International Search Report issued in International Patent Application No. PCT/US2012/061169; Mailed Mar. 8, 2013; 3 Pages.

PCT; Written Opinion of the International Searching Authority issued in International Patent Application No. PCT/US2012/061169; Mailed Mar. 8, 2013; 4 Pages.

Schraub et al.; U.S. Appl. No. 13/291,800, filed Nov. 8, 2011.

Walsh et al.; International Patent Application Serial No. PCT/US2012/061169; Filed Oct. 19, 2012; 58 Pages.

Kalenian et al.; U.S. Appl. No. 13/740,101, filed Jan. 11, 2013.

Kalenian et al.; International Patent Application Serial No. PCT/US2013/021319; Filed Jan. 11, 2013; 61 Pages Sony; "Digital Gauge Measuring Unit DK Series"; Catalog #497; 2005; 2 Pages.

THK; "Features of the Cross-Roller Ring—THK Technical Support"; published before Oct. 2011; 3 Pages.

Heidenhain Encoders; "Heidenhain Magnetic Modular Encoders" Internet Catalog; At least Jul. 2011; 1 Page.

Tamar Technology; Reference Manual for Wafer Thickness Sensor (WTS) WinSock Server; Version 1.0; Feb. 15, 2011; 23 Pages.

Tamar Technology; WTS Optical Head; Published before Oct. 21, 2011; 4 Pages.

PCT; Notification of Transmittal of the International Search Report and the Written Opinion of the International Searching Authority issued in International Patent Application No. PCT/US2013/021319; Mailed Mar. 19, 2013; 2 pages.

PCT; International Search Report issued in International Patent Application No. PCT/US2013/021319; Mailed Mar. 19, 2013; 2 pages.

PCT; Written Opinion of the International Searching Authority issued in International Patent Application No. PCT/US2013/021319; Mailed Mar. 19, 2013; 4 pages.

Brake et al.; U.S. Appl. No. 14/042,591, filed Sep. 30, 2013; 39 Pages.

Walsh et al.; U.S. Appl. No. 14/042,600, filed Sep. 30, 2013; 39 Pages.

* cited by examiner

Rotary Index Assembly

Rotary index Assembly Mounted in Lower Casting
(View from underside)

SYSTEMS AND METHODS OF WAFER GRINDING

This application claims the benefit of U.S. Provisional Application No. 61/549,787, filed Oct. 21, 2011, for Walsh et al., entitled SYSTEMS AND METHODS OF WAFER GRINDING; U.S. Provisional Application No. 61/585,643, filed Jan. 11, 2012, for Walsh et al., entitled SYSTEMS AND METHODS OF PROCESSING SUBSTRATES; U.S. Provisional Application No. 61/708,146, filed Oct. 1, 2012, for Brake et al., entitled METHODS AND SYSTEMS FOR USE IN GRIND SHAPE CONTROL ADAPTATION; U.S. Provisional Application No. 61/708,165, filed Oct. 1, 2012, for Walsh et al., entitled METHODS AND SYSTEMS FOR USE IN GRIND SPINDLE ALIGNMENT; U.S. Provisional Application No. 61/632,262, filed Jan. 23, 2012, for Vogtmann et al., entitled METHOD AND APPARATUS FOR CLEANING GRINDING WORK CHUCK USING A SCRAPER; and U.S. Provisional Application No. 61/631,102, filed Dec. 28, 2011, for Michael Vogtmann, entitled METHOD AND APPARATUS FOR CLEANING GRINDING WORKCHUCK USING A VACUUM; each of which is incorporated in its entirety herein by reference.

BACKGROUND

1. Field of the Invention

The present invention relates generally to wafer processing, and more specifically to wafer grinding.

2. Discussion of the Related Art

It is common, such as with some conventional semiconductor wafers on which circuit patterns are formed on one side (a front side), to be subjected to a grinding process so as to reduce the overall thickness of the wafer. Grinding is typically performed on the back surface of the wafer. The resultant thinning of the wafer allows for the production of thinner packaged electronic chips, microchips, and the like. In some instances, the thickness of a microchip cannot exceed a predefined thickness. Various other advantages are achieved by reducing the thickness of the wafers.

Backside wafer grinding is often accomplished using a grinding wheel that is applied to the backside of the wafer. Pressure is applied while grinding in attempts to achieve desired thicknesses.

SUMMARY OF THE INVENTION

Several embodiments advantageously address the needs above as well as other needs by providing grinding apparatuses and methods. Some embodiments provide grinding apparatus, comprising: a base casting; a rotary indexer positioned within the base casting, wherein the rotary indexer is configured to rotate within the base casting and about a first axis; a first work spindle secured with the rotary indexer; a first work chuck coupled with the first work spindle, wherein the first work spindle is configured to rotate the first work chuck about a second axis; a bridge casting rigidly secured relative to the base casting, wherein the bridge casting bridges across at least a portion of the rotary indexer and is supported on opposite sides of the rotary indexer structurally forming a closed stiffness loop; a grind spindle secured with the bridge casting; a first grind wheel cooperated with the grind spindle such that the grind spindle is configured to rotate the first grind wheel, wherein the bridge casting secures the grind spindle such that the first grind wheel is positioned over the rotary indexer to generally align with at least a portion of the first work chuck when the first work spindle is rotated by the rotary indexer into a corresponding position.

Other embodiments provide methods of wafer grinding. These methods comprise: rotating a rotary indexer about a first axis and rotationally orienting a work chuck and work spindle into a load position; applying a vacuum pressure to secure a wafer to the work chuck; rotating the rotary indexer to rotationally orient the work chuck and work spindle into a grind position such that the wafer is at least partially aligned with a coarse grind wheel; activating a grind spindle to apply the coarse grind wheel to the wafer to grind the wafer according to a coarse grind recipe; detecting that the wafer has been ground to a predefined coarse grind thickness; activating the grind spindle to apply a fine grind wheel to grind the wafer according to a fine grind recipe, wherein the fine grind wheel is nested with the coarse grind wheel such that the coarse and fine grind wheels are coaxially aligned about a second axis that is different than the first axis and around which the first and second grind wheels are rotated by the grind spindle; detecting that the wafer has been ground to a predefined fine grind thickness; and rotating, after the detecting that the wafer has been ground to the predefined fine grind thickness, the rotary indexer to the first position such that the work chuck is rotationally orienting into the load position allowing the wafer to be removed.

Still further embodiments provide methods of grinding a wafer comprising: rotating a rotary indexer positioning a work chuck and work spindle secured with the rotary indexer to a load position allowing ready access to position a wafer on the work chuck; rotating the rotary indexer and positioning the work spindle and work chuck to a grind position generally aligned with at least a portion of a grind wheel supported and rotated by a grind spindle; preventing a shifting of a center of gravity of the rotary indexer as the rotary indexer rotates the work chuck by securing a counter balance on the rotary indexer relative to the work spindle.

Additionally, some embodiments provide methods of grinding a wafer, comprising: rotating a rotary indexer positioning a work chuck and work spindle secured with the rotary indexer to a load position allowing ready access to position a wafer on the work chuck; rotating the rotary indexer and positioning the work spindle and work chuck to a grind position generally aligned with at least a portion of a grind wheel supported and rotated by a grind spindle; preventing a shifting of a center of gravity of the rotary indexer as the rotary indexer rotates the work chuck by securing a counter balance on the rotary indexer relative to the work spindle.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
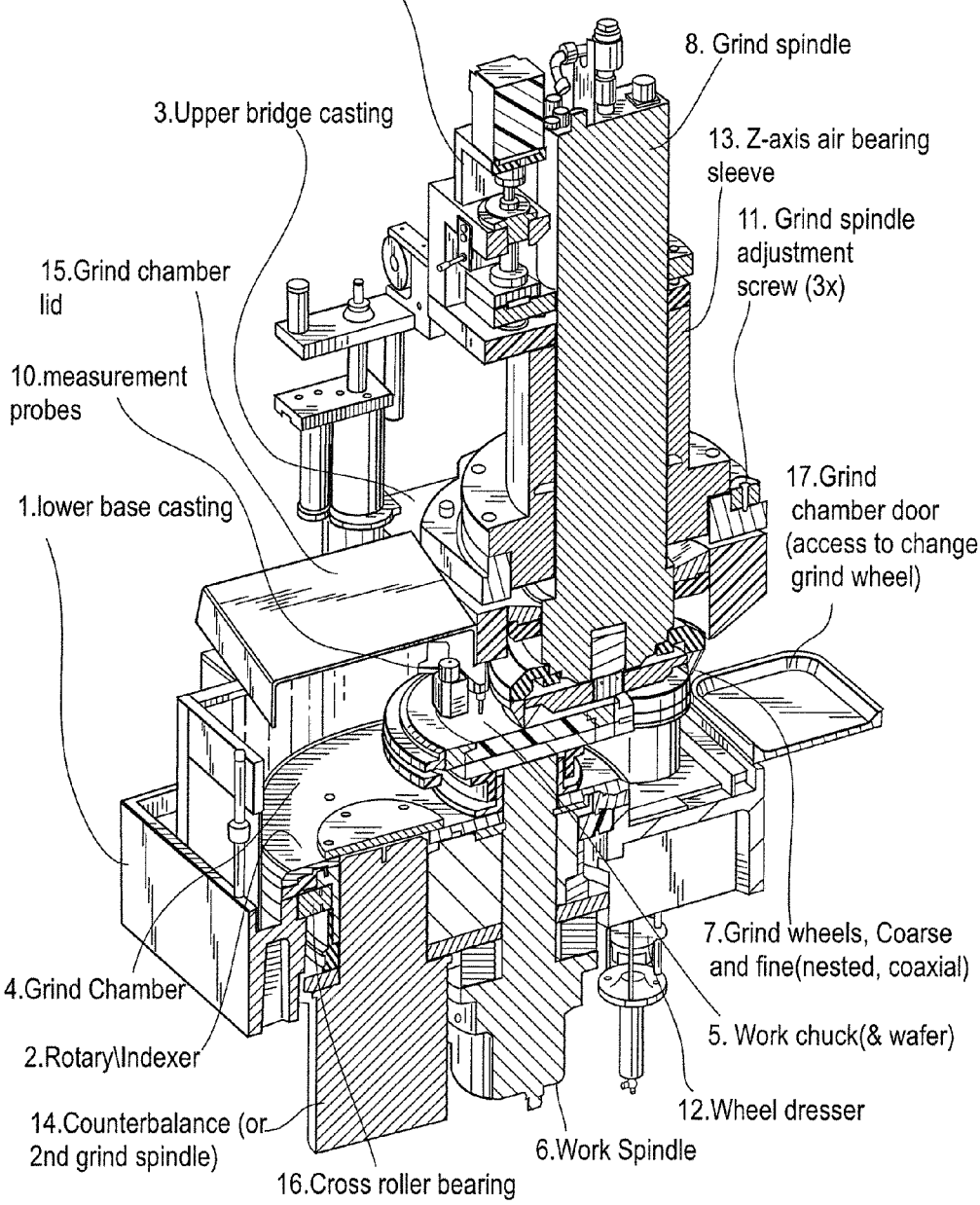
FIG. 1 depicts a simplified, partial cross-sectional view of a grinding system, module or engine according to some embodiments.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," "some embodiments," "some implementations" or similar language means that a particular feature, structure, or characteristic described in connection with the embodiment is included in at least one embodiment of the present invention. Thus, appearances of the phrases "in one embodiment," "in an embodiment," "in some embodiments," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of apparatuses, components of apparatuses, processes, control structures and methods, programming, software modules, user actions or selections, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Some present embodiments provide for wafer grinding, including but not limited to semiconductor wafer backgrinding. For example, some embodiments provide for silicon wafer grinding for semiconductors and/or other relatively hard materials wafer grinding, including for example grinding for Light-Emitting Diode (LED) manufacture. The relatively hard materials can include sapphire, silicon carbide, Aluminum-Titanium Carbide (AlTiC) for giant magnetoresistive (GMR) hard disk drive (HDD) heads and other such relatively hard materials. In some instances, the grinding systems and/or processes can be implemented and/or cooperated with other systems and/or apparatuses, such as robotics, front-end modules, automation machines, thin wafer handling, in situ and ex situ wafer thickness monitoring grind force measurement, servicing access for grinder components (like grind wheels), and other such systems and/or automations.

Some embodiments provide systems and methods of wafer grinding that comprise several sub-systems and improvements over the prior systems and methods. Many of these sub-systems provide inventive features and processes, and the methods and/or processes of using each and the entire system provides methods to achieve levels of ground wafer quality not achievable by means of other equipment or methods.

Figure 2:
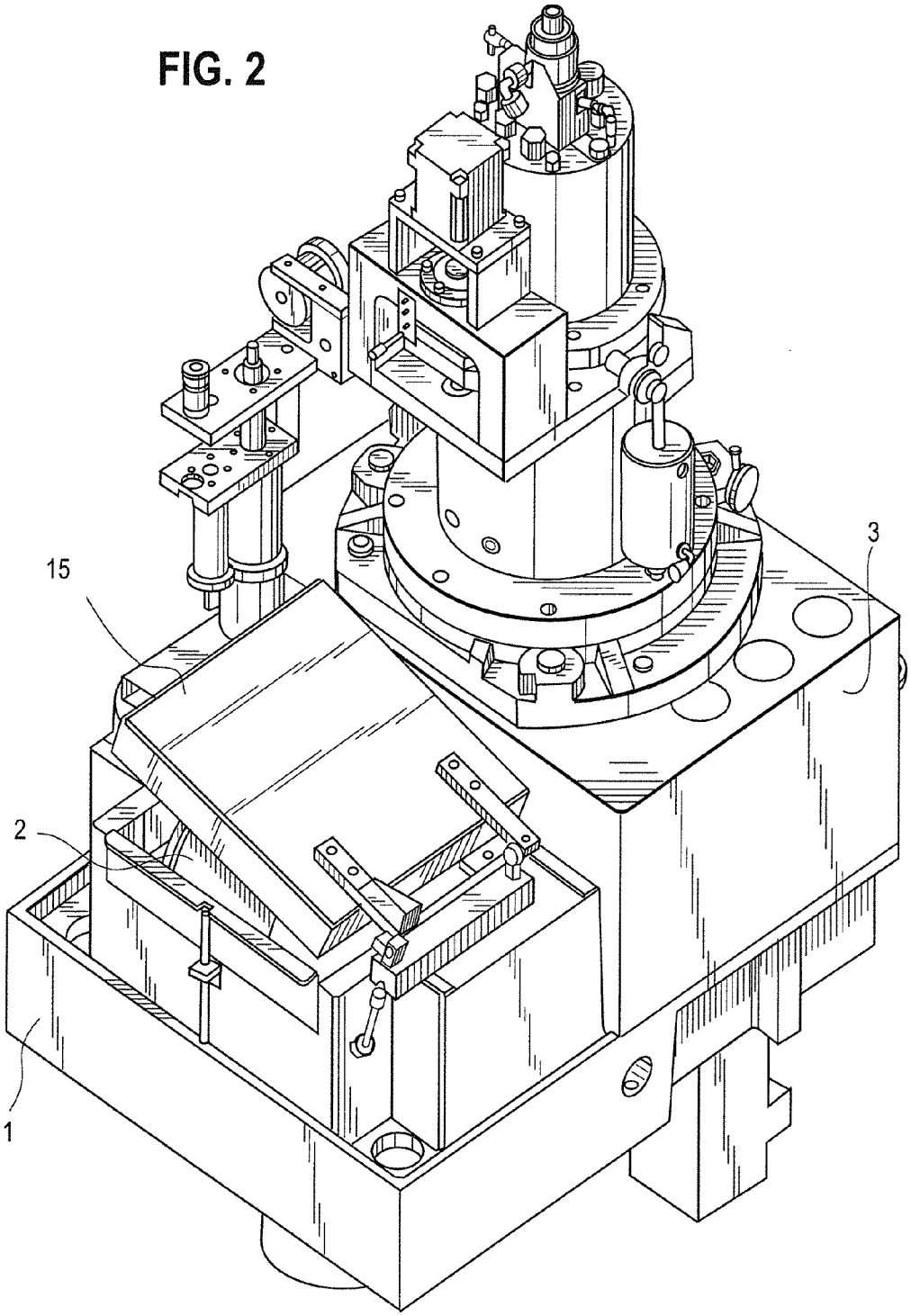
FIG. 2 shows a perspective view of the grinding system of FIG. 1.

FIG. 1 depicts a simplified, partial cross-sectional view of a grinding system, module or engine according to some embodiments. FIG. 2 shows a perspective view of the grinding system. In some embodiments the system provides a relatively compact grinding system or engine. The engine is the area and device where the actual grinding takes place. The grind engine, in some embodiments, comprises some or all of the following elements and assemblies:

A Lower Base Casting (1): The lower base casting, in some embodiments, comprises a rigid base upon which the grind engine can be mounted into a frame. Additionally the rigid base, which in some instances can be made out of cast iron, steel, polymer concrete or other relevant material, is designed to provide a rigid mounting for the lower components of the grind engine. For example, the lower base casting (1) is designed to accept a rotary indexer (2), described in detail below. The rotary indexer (2), in turn, provides for mounting of the lower grind chuck work air bearing spindle(s) (the "work spindle(s)). A porous chuck (the "work chuck," which in some instances is a ceramic chuck) is mounted to the air bearing spindle, and wafers are affixed to the work chuck during grinding. The base also allows connection of a stiff bridge casting (3) which spans above much of the lower base casting.

A Rotary Indexer (2): The rotary indexer is mounted into the lower base casting. In some embodiments, the rotary indexer (2) can have a cylindrical cross-section. Further, the rotary indexer (2) is mounted with the lower base, for example, by way of a high precision preloaded sealed cross roller ring bearing (16), which provides for the ability to rotate the rotary indexer while increasing stiffness and in some instances maximizing stiffness in multiple or all planes and moment loading. In other embodiments, one or more air bearings can be used in cooperation with or in place of one or more cross roller bearings to support and index the rotary indexer. A servo controlled motor, gear reduction, and belt system can be used to index the rotary indexer to various positions.

An Upper Bridge Casting (3): A rigid casting that is secured (e.g., bolted) to the lower base casting. The upper bridge casting 3 is configured and positioned to mount the upper grind air bearing spindle 8 (the "grind spindle"). The bridge casting, in some embodiments, is made out of cast iron and provides for higher stiffness than previous cantilevered arm designs, while still providing desired access for servicing the machine. In some embodiments, the bridge casting 3 is rigidly secured relative to the base casting 1, and in some instances with the base casting 1. In some implementations the bridge casting 3 extends from the base casting 1 generally away from the rotary indexer 2. The bridge casting 3 bridges across at least a portion of the rotary indexer 1, and in some instances across a diameter of the rotary indexer, and is supported on opposite sides of the rotary indexer 2 by the base casting. The bridge casting 3 is rigidly secured relative to the base casting structurally forming a closed stiffness loop. Further, the bridge casting 3 rigidly secures the grind spindle 8 relative to the base casting 3 and rotary indexer 2 such that the first grind wheel is positioned over the rotary indexer to generally align with at least a portion of the work chuck 5 when the work spindle 6 is rotated by the rotary indexer 2 into a corresponding grind position.

A Grind Chamber (4): The lower base casting 2 and upper bridge castings 3, along with other sheet metal and machined components form the grind chamber (4), or the area where the grinding occurs. The grind chamber (4) can in some implementations be sealed during grinding with one or more lids or doors (15) to prevent the grind effluent and swarf from slinging outside of the chamber. Exhaust and drain connections are provided to the grind chamber to provide for the removal of humid air, grind effluent, swarf, deionized water and the like. In some instances, coolant and/or other liquids may be at atomized, which may result in a fog that can be evacuated through the exhaust. In some embodiments, the grind chamber air volume is exchanged about each 2-5 second intervals.

One or more Work Chucks (5) and Work Spindles (6): The work chuck 5 and/or work spindles 6 can be implemented, in some embodiments, through an air bearing type spindle, which can provide for an improved or maximum stiffness and precision alignment of the spindle. The work chuck 5, which in some embodiments is an assembly with a porous ceramic surface, is configured to affix a wafer via a vacuum force during grinding to an ultra flat (or precision shaped) surface during the grinding process. The air bearing spindle has an integrated motor used to rotate the work chuck and wafer during grinding. A force sensing device, previously described by U.S. Pat. No. 7,458,878, which is incorporated herein by reference, is integrated into the spindle to measure the amount of force imparted by the grind wheel against the wafer during grinding.

Figure 3:
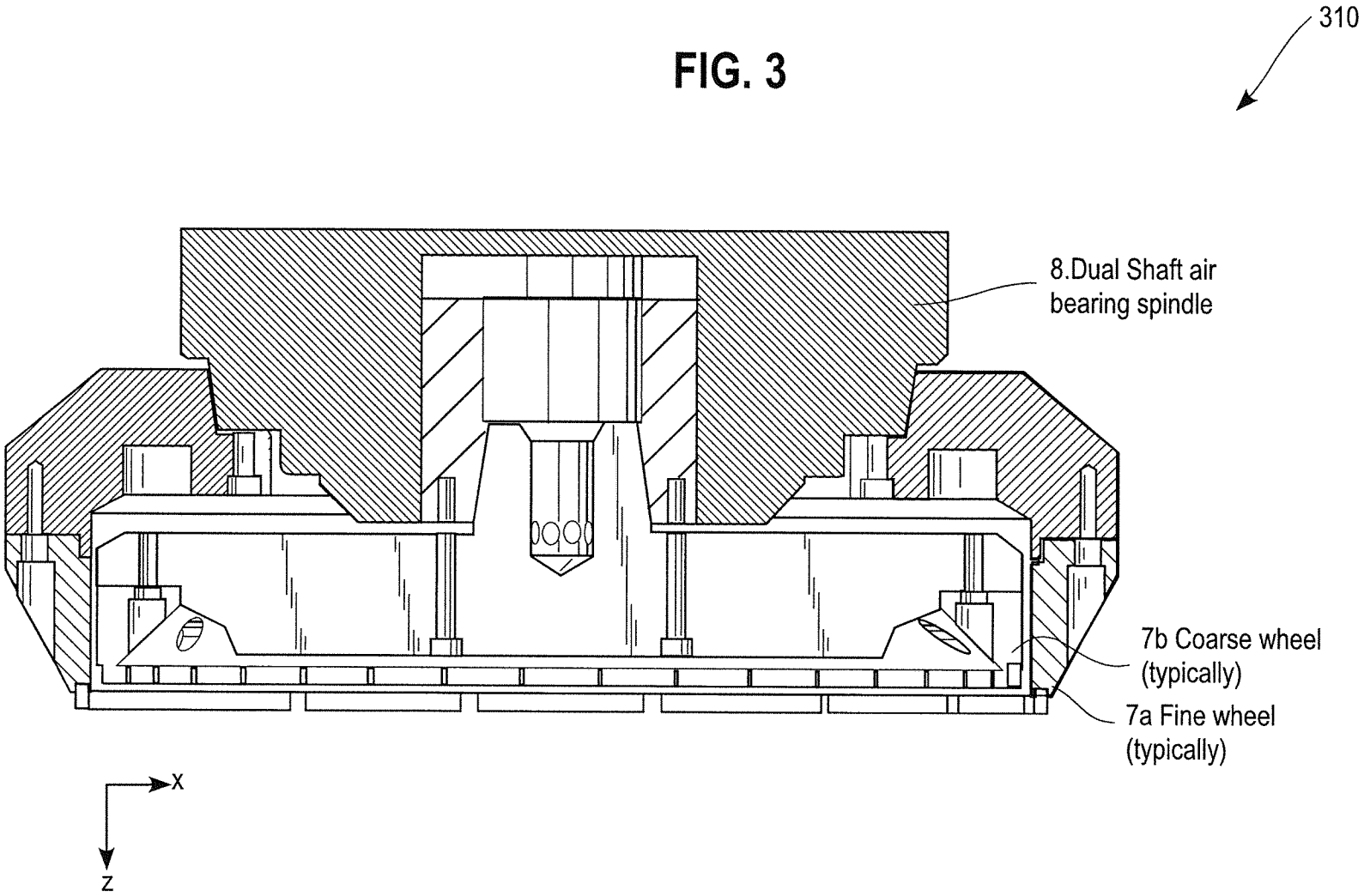
FIG. 3 shows a simplified cross-sectional view of a grind wheel assembly according to some embodiments.

One or more Grind Wheels (7) and Coaxial Grind Spindle (8) (see also FIG. 12): The grinding is performed by grind wheels 7 attached to an air bearing grind spindle 8, which is positioned relative to the wafer during grind (in some embodiments positioned above the wafer). The grind spindle 8 can be implemented with or be similar to the spindles described in U.S. Pat. No. 7,118,446, which is incorporated herein by reference. It provides for coaxial, nested grind wheels 7, such as coarse and fine wheels, for convenient two step grinding in the same chucking. FIG. 3 shows a simplified cross-sectional view of a grind wheel assembly 310 according to some embodiments. The grind wheel assembly 310 is cooperated with the grind spindle 8, which in some embodiments comprises a dual shaft air bearing spindle. In the embodiment of the grind wheel assembly 310 of FIG. 3, the grind wheel assembly includes a two coaxially aligned fine grind wheel 7*a* nested with a coarse grind wheel 7*b* such that the coarse and fine grind wheels are coaxially aligned about an axis (the Z- or vertical axis, which is typically aligned with a rotational axis of the grind spindle 8). Further, the two grind wheels can separately and independently be extended in the Z-axis when implementing coarse or fine grinding.

Referring back to FIG. 1, infeed ("z-axis") movement can also be facilitated by a separate Z-Axis Air Bearing Sleeve (13), which in some embodiments is within the air bearing spindle assembly of the grind spindle 8. The grind wheels 7 are rotated at fast speeds during grinding via a motor which is cooperated with the air bearing spindle assembly, for example affixed atop the air bearing spindle assembly. For example, in some instances, the grind wheel can be rotated at speeds of about 1200-5000 RPM or more.

In some embodiments, the grinding spindle 8 supporting the dual grind wheels 7*a-b* is vertically supported in the air bearing sleeve 13. The air bearing sleeve can be very close fitting and extends along a portion of a length the grind spindle 8 providing increased stability. The air bearing sleeve 13 can provide an air film under pressure firmly supporting the grind spindle 8, while still allowing rotational and axially movement of the grind spindle, which in some instances is virtually friction free. The air bearing provided by the air bearing sleeve 13 encircles the portion of the grind spindle 8. In some embodiments, the air bearing and/or air bearing sleeve are on the order of the same diameter as the grinding wheel and/or grind wheel assemblies, and accordingly resists moment load deflections due to grind forces. Some implementations include one or more precision balls or planetary lead screws that can be used to provide vertical spindle positioning. In some embodiments, the weight of the grind spindle 8 is substantially counter balanced, for example, through a plurality of rolling diaphragm air cylinders positioned on either side of and/or around the grind spindle 8.

Z-Axis Lead Screw Assembly (9): Infeed grinding movement is enabled via a servo controlled motor directly connected to a fine-pitch precision ground pre-loaded planetary roller or ball screw. As the motor turns the ball screw, the grind wheel air bearing grind spindle 8 is lowered or lifted. A very precise encoding device allows a controller or computer to track the rotation of the screw and implied z-axis displacement. The precision and force control, in at least some embodiments, is enabled through relatively friction free z-axis linear air bearings, thus eliminating at least the friction that produces a stick-slip phenomenon that can result in a loss of precision. The air bearings enable precision positioning and grind force measurements, and thereby control.

Measurement Probes (10): In some embodiments, the grind system or module includes one or more contact-type measurement probes 10, which can be mounted at a location above the grind position of the wafer and work chuck 5. Before a wafer is loaded onto the work chuck for grinding, probes, for example two probes, reference the distance to the surface of the work chuck. During grinding, one probe continues to monitor the position of the work chuck surface (just outside the outer diameter of the wafer) while the other probe monitors the thickness of the wafer while it is ground. The grinding process can be programmed to stop when a predetermined thickness is achieved or when a predetermined amount is removed.

Figure 4:
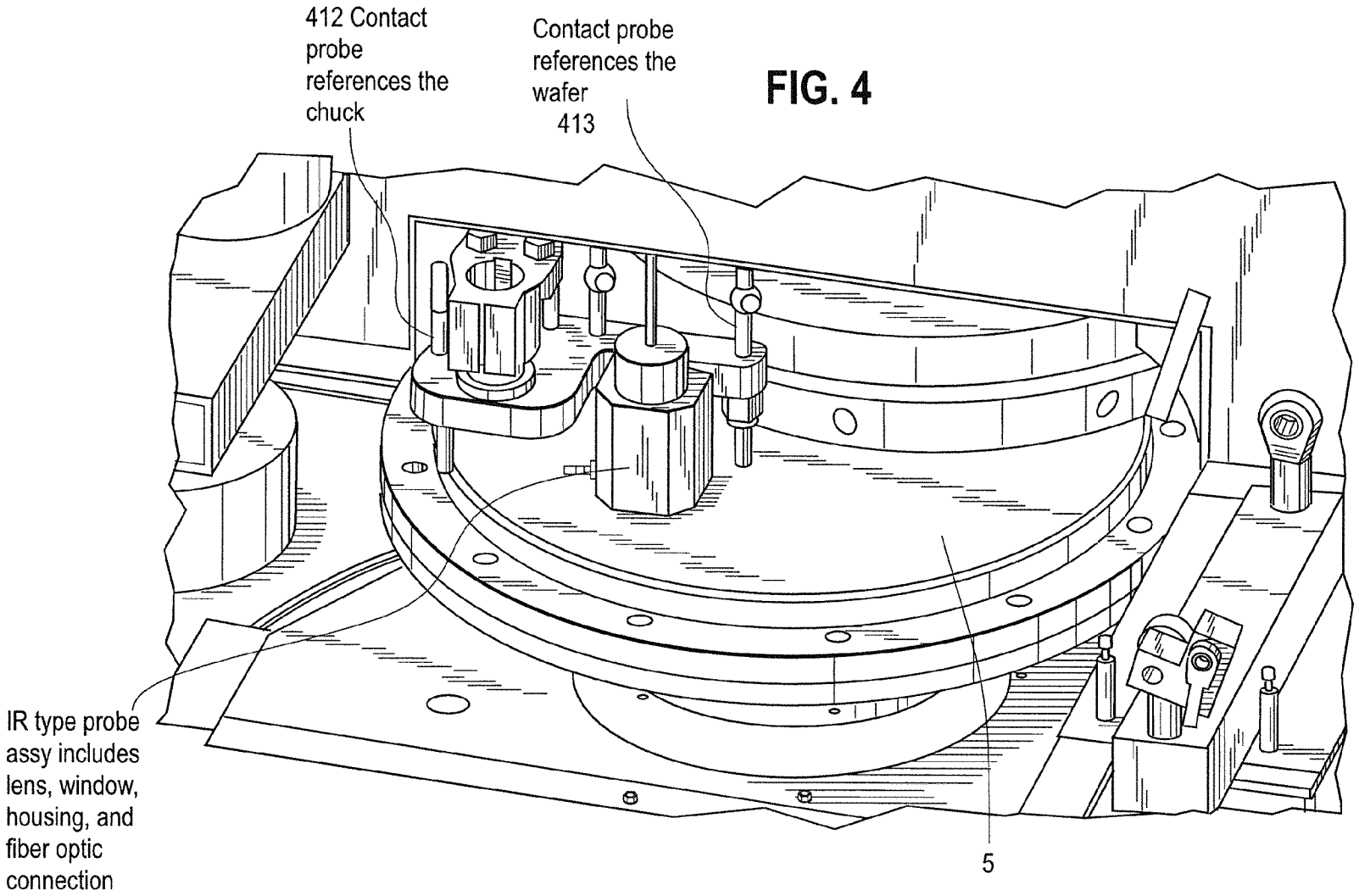
FIG. 4 depicts a simplified perspective view of a set of contact probes that track positioning and/or thickness of a wafer during placement and/or grinding, according to some embodiments.

FIG. 4 depicts a simplified perspective view of a set of contact probes 412, 413 that track positioning and/or thickness of a wafer during placement and/or grinding, according to some embodiments, and typically relative to a surface of the work chuck 5. Some embodiments additionally or alternatively include one or more non-contact probes 416, such as an optical probe. In some embodiments, one or more contact probes 412-413 reference the work chuck 5 prior to wafer delivery. Additionally or alternatively, during grinding one probe (e.g., contact probe 413) can track wafer thickness, while another probe 412 continues to reference the work chuck surface. Further, in some embodiments, the chuck probe 412 provides feedback to monitor whether a chuck reference position has changed since the original referencing before grinding. The work chuck reference position can change due to thermal effects and grind force stresses. If the chuck reference position changes, the wafer probe measurement can then be corrected using information from the work chuck probe 412. For example, some embodiments utilize a digital gauge with extremely high resolution (e.g., 0.1 μm), such as a magnetic digital gauge or probe from Sony (e.g., DK812VR), Marposs S.p.A., Heidenhain, or other such gauge suppliers. In some implementations, the gauge can be positioned proximate to or against the wafer and/or chuck, such as through pressurized air. The assembly is sealed from the elements and has an Ingress Protection (IP) rating (e.g., an IP66 rating) for protection. The digital gauge can communicate with the grinder controller or computer via an encoder (e.g., quadrature) type input.

Figure 5:
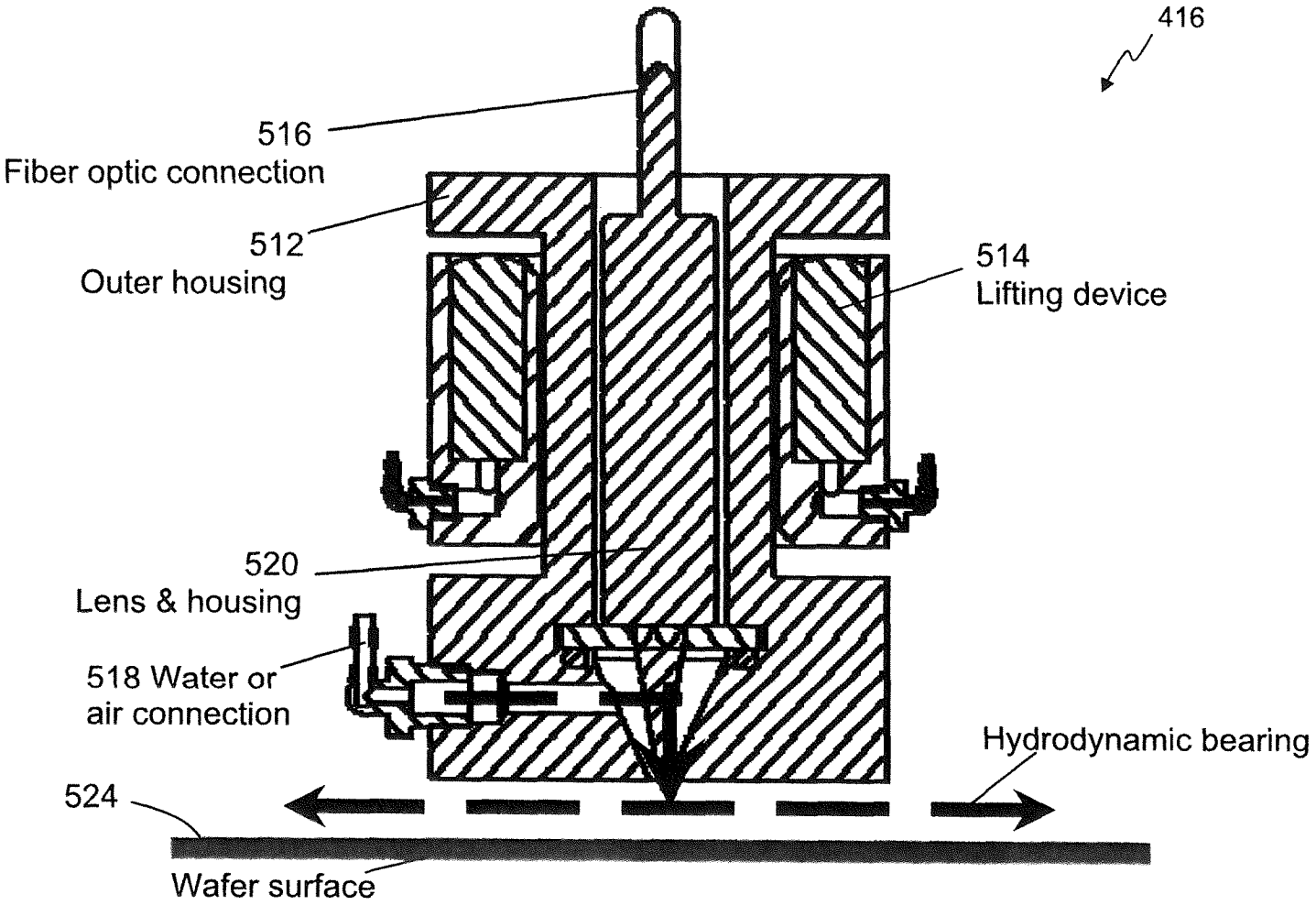
FIG. 5 depicts a simplified cross-sectional view of an optical probe that can be implemented in a grind engine, according to some embodiments.

FIG. 5 depicts a simplified cross-sectional view of an optical probe 416 that can be implemented in a grind engine, according to some embodiments. In some embodiments, the systems and/or methods may further be used with stacked wafer grinding applications, which in some instances can include a non-contact probe 416, such as an infrared (IR) type probe, that may be used to measure through the wafer during one or more grinding steps to measure thickness, where thickness in some instances can be continuously monitored (e.g., by the probes). The IR-type probe has the capability to measure the top wafer thickness, providing more precise thickness feedback to the grinder. The IR-type probe 416 can be implemented, in some embodiments, with an optical probe from Tamar Technology (e.g., wafer thickness sensor (WTS) optical head with 5×, 20× or other objective; a WTS optical head with fiber patchcord connected), sensors from Precitech, Keyence, interferometry sensors, or other such sensors. Further, the IR probe 416 may include a housing 512 and be secured with the grind system through various methods, such as described in U.S. patent application Ser. No. 13/291,800, filed Nov. 8, 2011, for Schraub et al., entitled SYSTEM AND METHOD FOR IN SITU MONITORING OF TOP WAFER THICKNESS IN A STACK OF WAFERS, which is incorporated in its entirety herein by reference. The sensor 416, in some embodiments, includes the housing 512, a lifting structure or device 514, a fiber optic connection 516, a fluid or gas inlet connector 518, a lens 520. In some instances a fluid (e.g., water) and/or gas (e.g., air) is injected in front of the lens 520 to clean a path for the IR light to impinge upon the wafer surface 524.

Figure 6:
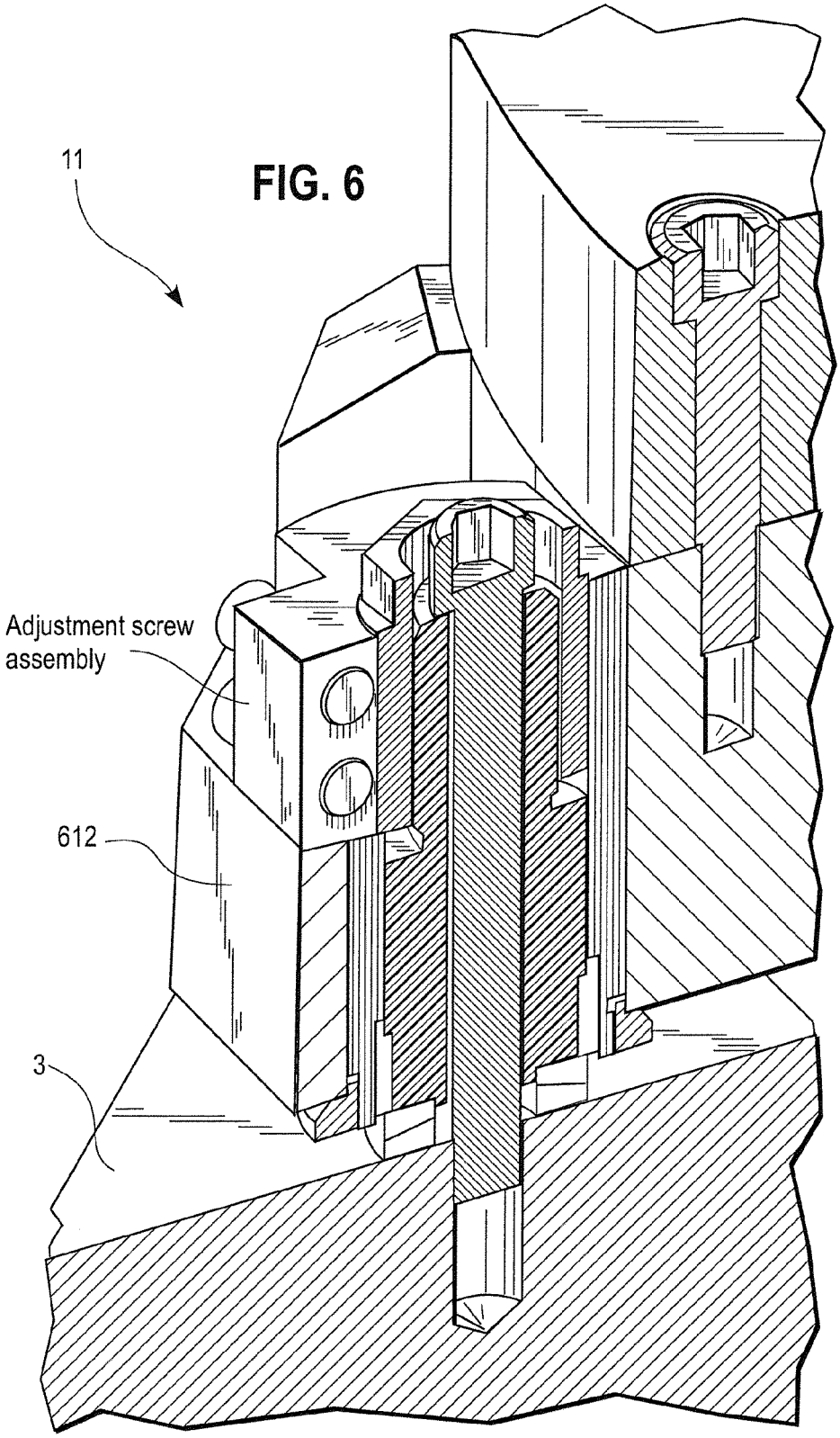
FIG. 6 depicts a simplified, partial cross-sectional view of the grind system with a manual grind spindle adjustment screw assembly 11, in accordance with some embodiments.

One or more Grind Spindle Adjustment Screw Assemblies (11): Referring back to FIG. 1, the upper grind spindle 8 is mounted to one or more grind spindle adjustment screw assemblies 11 (e.g., three adjustment screw assemblies located at 120 degrees from one another). These adjustment screw assemblies provide for the ability to rigidly position the grind spindle 8, yet also align the grind spindle pitch and yaw relative to the wafer and/or work chuck 5 to achieve a desired ground wafer surface. FIG. 6 depicts a simplified, partial cross-sectional view of the grind system with a manual grind spindle adjustment screw assembly 11 and corresponding nut cooperating the grind spindle 3 through a grind spindle mounting plate 612 with the bridge casting 3, in accordance with some embodiments. In some embodiments, the grind spindle adjustment screw assembly 11 mechanically cooperates or attaches to a grind spindle mounting plate 612 cooperated with the grind spindle 8 in a way that allows the angle of the grind spindle 8 to be adjusted relative to the base casting 1 and rotary indexer 2. Grind spindle alignment can be a primary contributor to the shape of the wafer after grinding, and it provides the ability to achieve a precise alignment of the spindle, which can often be critical.

In some embodiments, the adjustments screw assemblies 11 can be manually set (e.g., via a wrench). Further, some embodiments utilize a dual-threaded device. The combination of the two nested threads provides for very fine pitch, or movement per revolution. In other embodiments, the adjustment method is automated and controlled by feedback and a controller (e.g., feedback through one or more sensors, motors and the like to a computer). The adjustment screw assemblies, and in some instances the automated adjustment of these adjustment screw assemblies, can enable wafer shape control.

A Wheel Dresser (12): Referring back to FIG. 1, the wheel dresser 12 comprises an apparatus that is positioned beneath the grind wheel teeth, and in some embodiments comprises a motor, reduction, and drive shaft that rotate an abrasive wheel. The wheel dresser also contains hardware to extend or retract the abrasive wheel. For some grind processes, the coarse and/or fine grind wheels can become "loaded-up," which reduces grind cut efficiency or portions of the wheel can become dulled. In some embodiments, one or more sensors are provided such that the machine can sense that the grind wheels are dull or loaded-up by comparing, for example, feed rate and grind forces. As forces increase to a predetermined level, the grind wheel can be treated while grinding or the grinding can be paused momentarily and dressing wheel extended and rotated. The abrasive dressing wheel contacts the grind wheel, exposing new grind wheel abrasive. When dressing is complete the dressing wheel is retracted and grinding of the wafer or other work object continues or resumes depending on whether grinding was interrupted. Some embodiments employ the dressing apparatuses and/or methods described in U.S. Pat. No. 7,118,446, which is incorporated herein by reference.

Figure 7A:
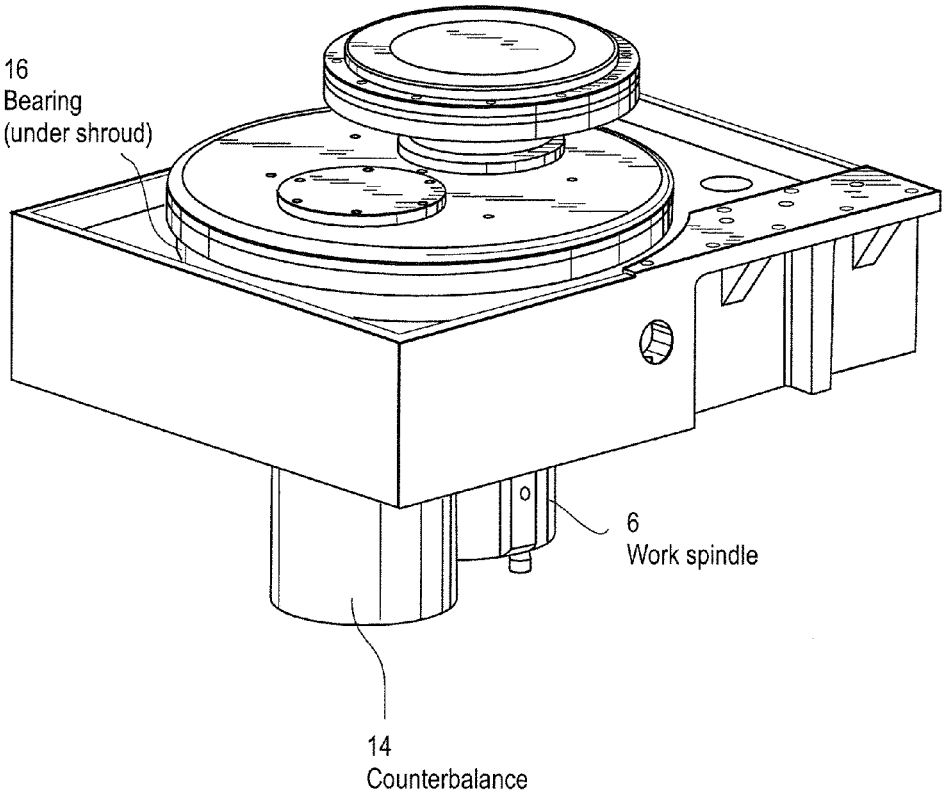
FIGS. 7A-B depict simplified overhead perspective views of a rotary indexer assembly, according to some embodiments.
Figure 7B:
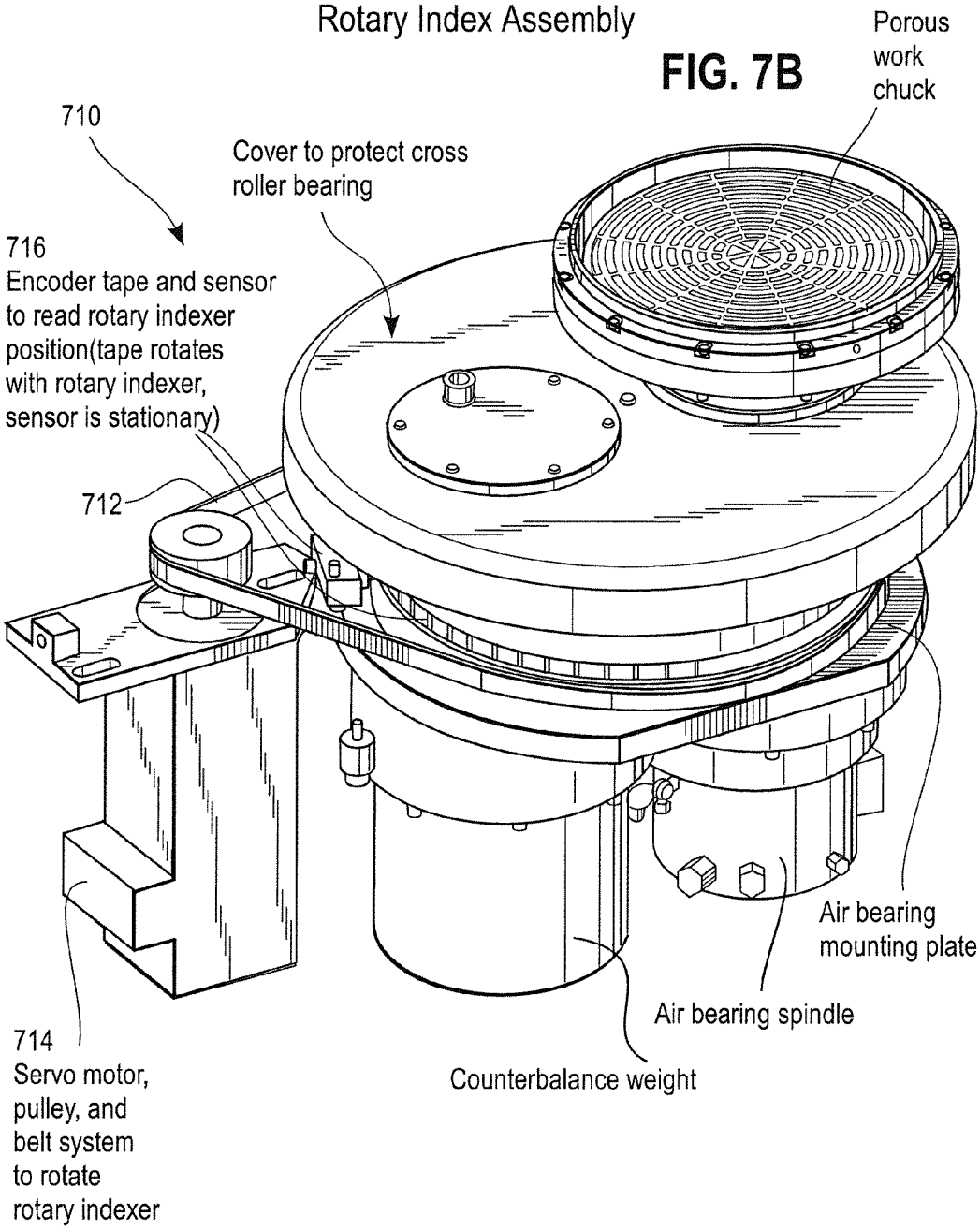
Figure 7C:
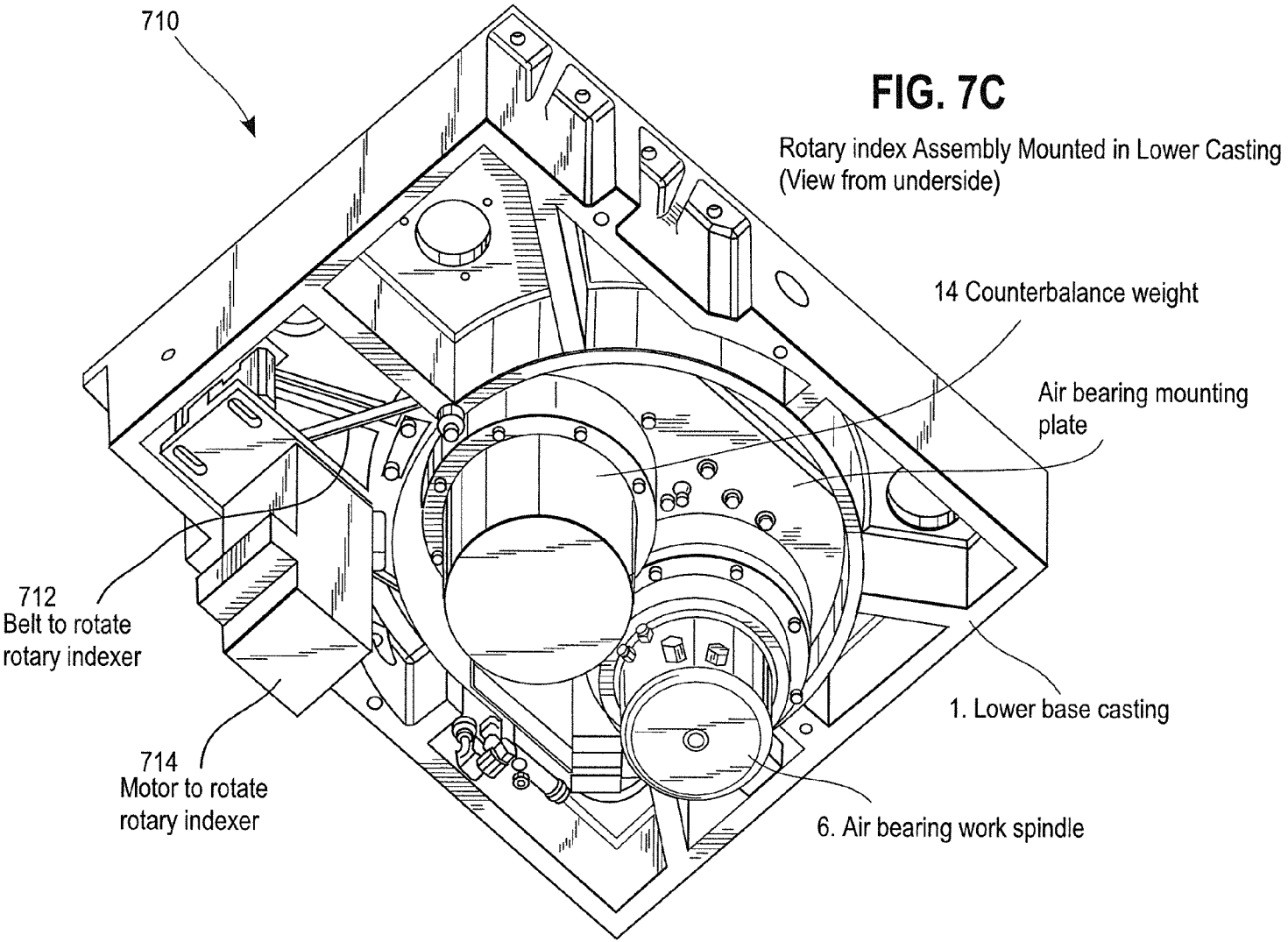
FIGS. 7C-D depict an underside perspective of a rotary indexer assembly cooperated with a base casting 1, according to some embodiments.
Figure 7D:
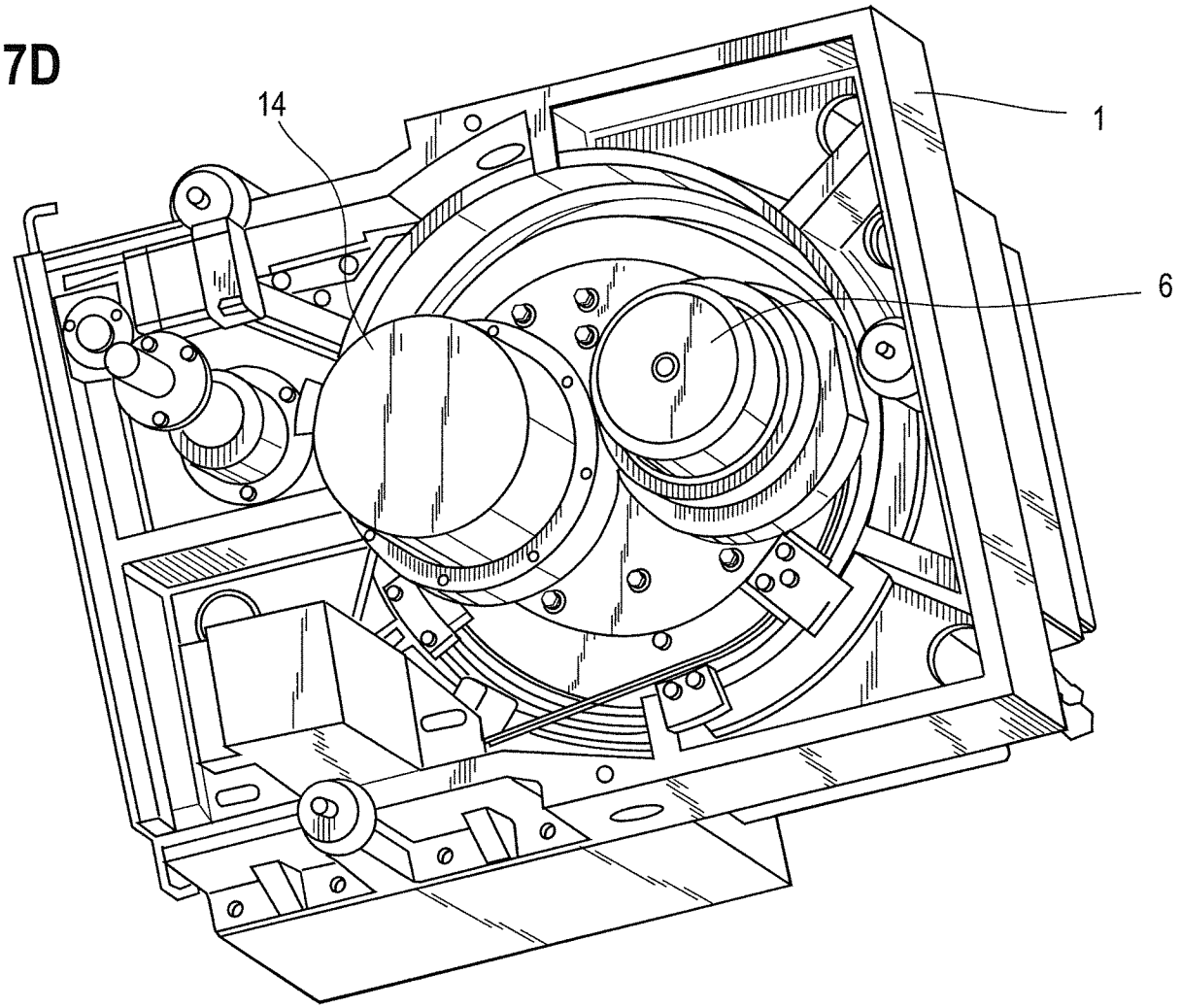
Figure 7E:
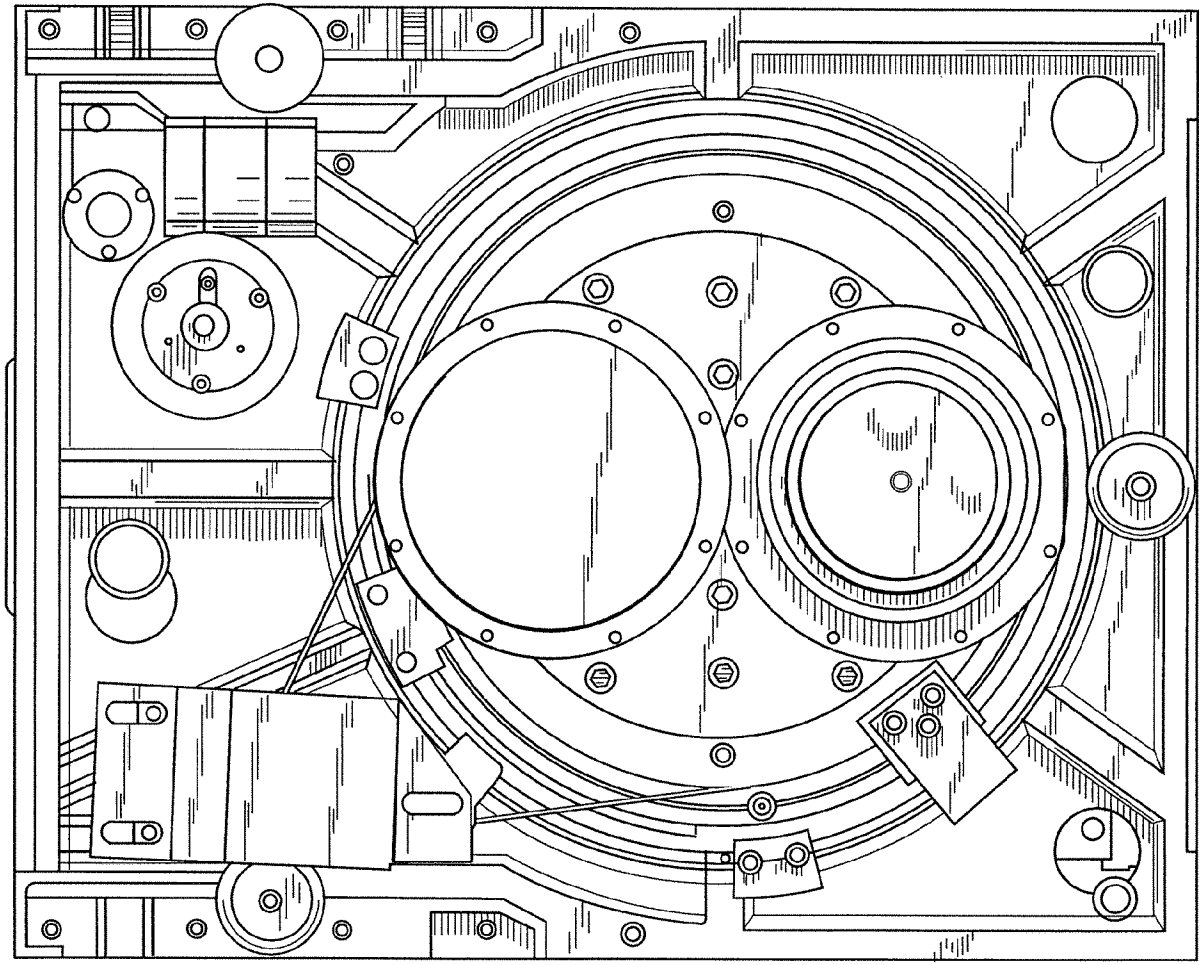
FIG. 7E depicts a plane view of an underside of a rotary indexer assembly cooperated with a base casting, in accordance with some embodiments.
Figure 8A:
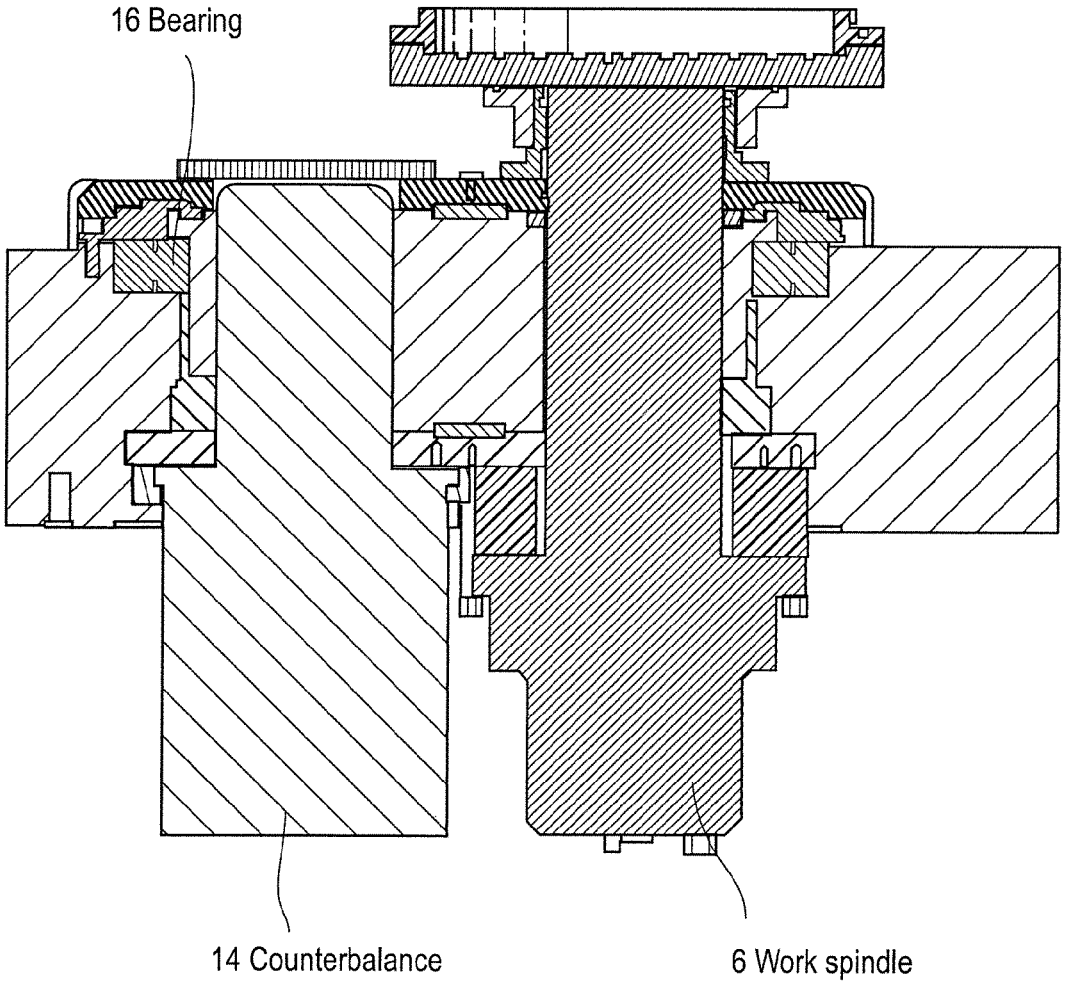
FIGS. 8A-B depict simplified cross-sectional views of the rotary indexer assemblies in accordance with some embodiments.
Figure 8B:
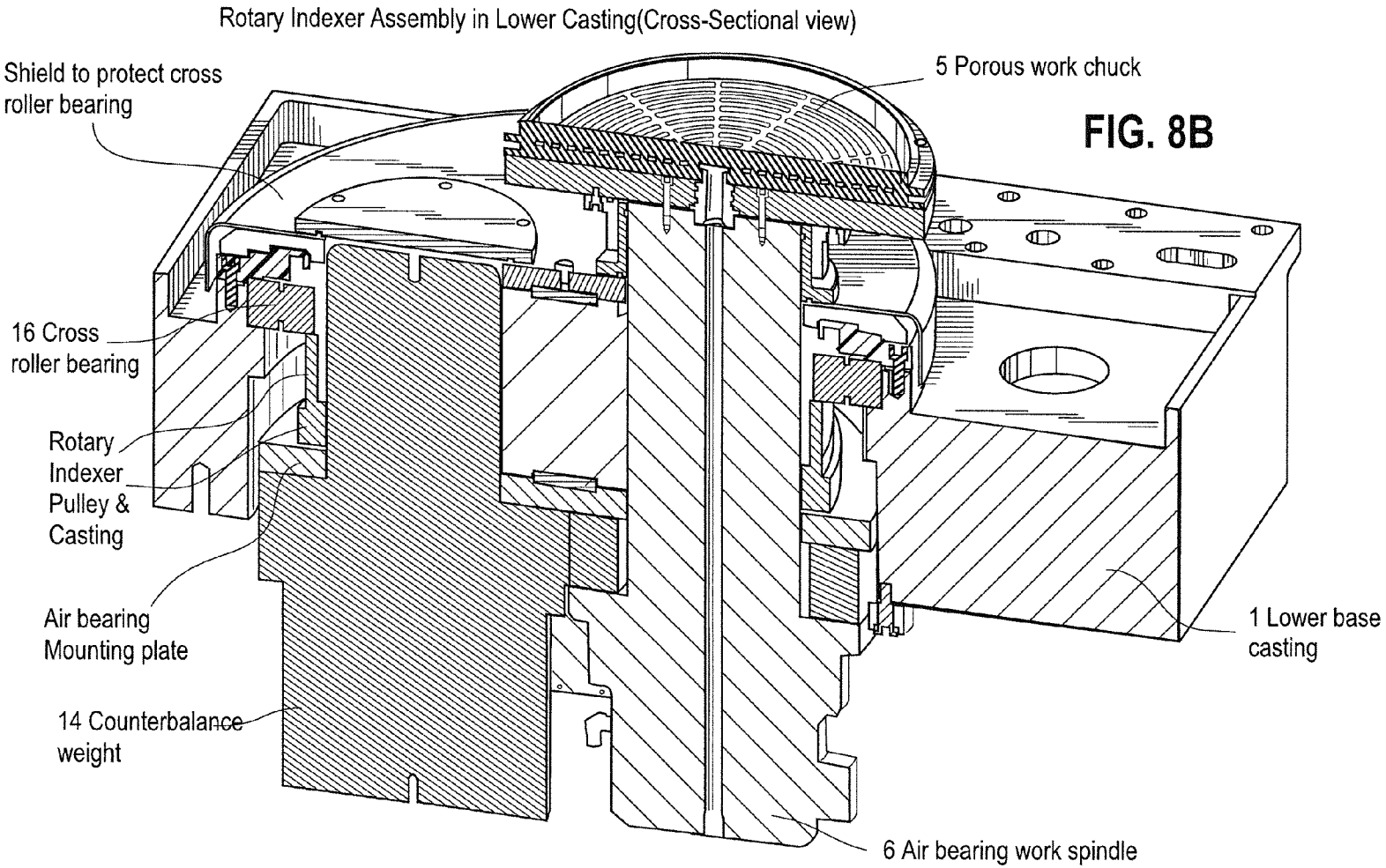
Figure 9:
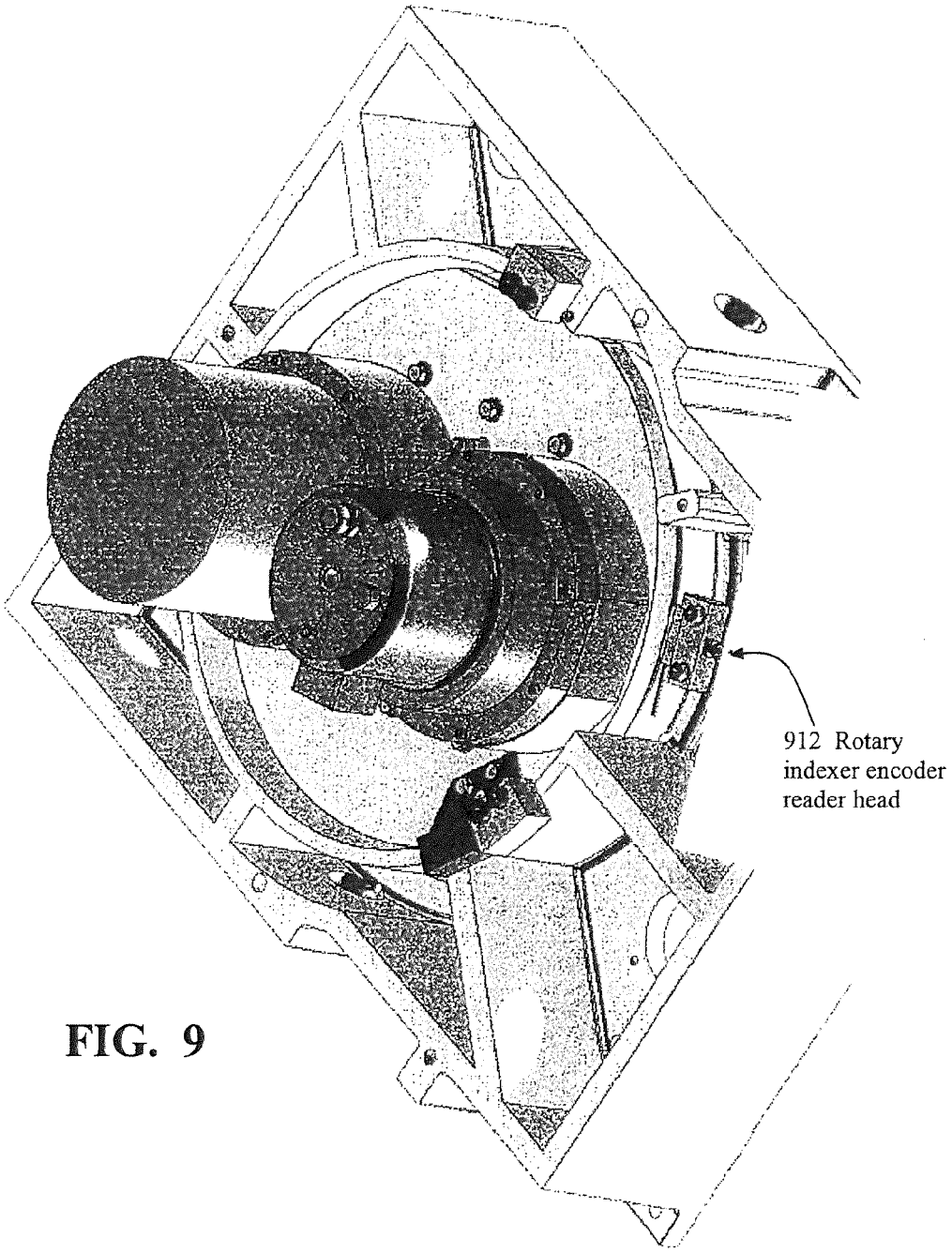
FIG. 9 shows a perspective view of the rotary indexer assembly including a rotary indexer encoder reader head.

The grind engine includes the rotatable rotary indexer 2 (which in some embodiments is circular), to which the work spindle(s) 6 are mounted within. FIGS. 7A-B depict simplified overhead perspective views of a rotary indexer assembly 710, FIGS. 7C-D depict an underside perspective of a rotary indexer assembly 710 cooperated with a base casting 1, and FIG. 7E depicts a plane view of an underside of a rotary indexer assembly 710 cooperated with a base casting 1, in accordance with some embodiments. FIGS. 8A-B depict simplified cross-sectional views of the rotary indexer assemblies 710 in accordance with some embodiments. The rotary indexer 2 provides in part for the following features:

Wafer/Chuck Positioning: The rotary indexer 2 provides, among other things, the ability to move the work chuck 5 and wafer to a load and/or unload position, i.e. a convenient spot for loading and unloading wafers from the work chuck, and to move a work chuck 5 and wafer to a grind position, typically location under at least a portion of one of the grind wheel(s) 7*a-b* for grinding. In some embodiments, the rotary indexer 2 includes a toothed ring gear affixed beneath the grinding area. A belt 712 or other such device is cooperated with the gear and to a motor 714 (e.g., servo driven motor) that can drive the belt 712 to rotate the rotary indexer 2. In some instances, a precision encoder tape or the like is affixed with the grinding rotary indexer 2. The encoder tape, in combination with a sensor device 716, monitors the exact angular position of the rotary indexer 2 as it is rotated. FIG. 9 shows a perspective view of the rotary indexer assembly 710 including a rotary indexer encoder reader head 912. The one or more grind spindles 8 are mounted face on to the rotary indexer 2 via a mounting flange, screws, bridge casting 3 and grind spindle adjustment screw assemblies 11. Air and fluids are coupled to the spindles while still allowing the rotary indexer 2 to freely rotate. In some instances, the rotating is limited to less than 360 degrees.

Figure 10:
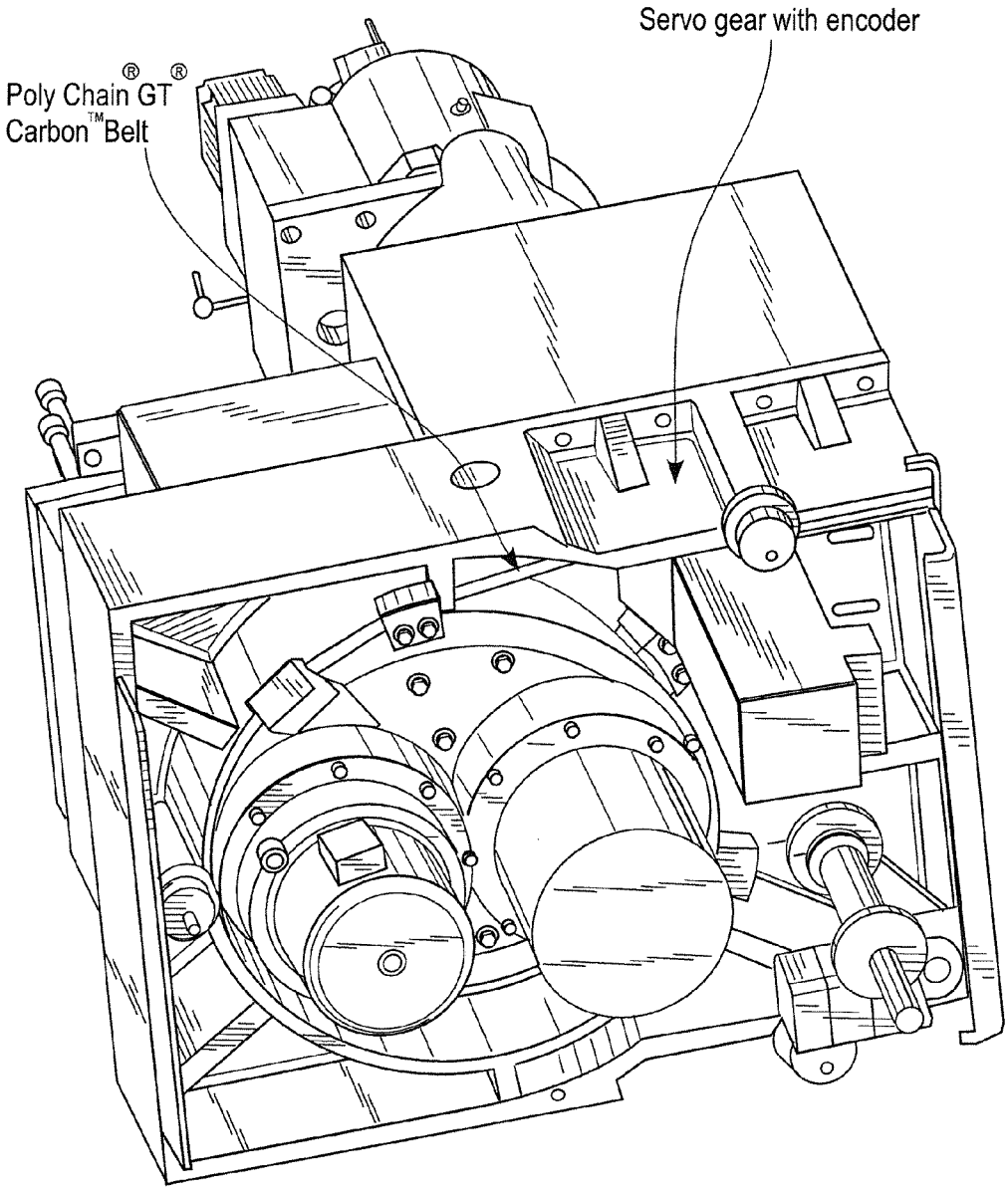
FIG. 10 depicts a perspective, underside view of a rotary indexer assembly cooperated in a grind module according to some embodiments.

In some embodiments, the rotary indexer 2 is driven by a geared servo motor 714 with a toothed pulley on an output shaft driving to a multipurpose pulley below the cross roller bearing by way of a positive drive belt (e.g., a Poly Chain® GT® Carbon™ Belt from Gates Corp.). FIG. 10 depicts a perspective, underside view of a rotary indexer assembly cooperated in a grind module according to some embodiments. The geared servo motor 714 can include an encoder that commutates with the motor, controls acceleration and speed while secondarily encoding the position of the rotary indexer. Alternatively or additionally, a primary positioning encoder 912 can be included and positioned around the rotary indexer pulley, such as above the pulley teeth. The one or more work spindles 6 are eccentrically mounted through holes in the rotary indexer. As described above, some embodiments are configured for two or more work spindles 6, and with these embodiments when only one spindle is used the second spindle mounting can be configured to house a dummy spindle or counter balance 14 to counterweight the rotary indexer 2 so that grind engine structure does not experience a shift in a center of gravity, which may cause minute structural deformation. The rotary indexer 2, in some implementations, is configured to rotate approximately 180 degrees, with a cable management system positioned below the rotary indexer that accommodates the motion.

The rotary indexer movement also enables the positioning of the wafer in the correct spots for one or both coarse and fine grinding with the coaxial spindle arrangement, depending on implementation. Some embodiments employ nested coarse and fine grind wheels 7*a-b*, and with such nesting the coarse and fine grind wheels have slightly different diameters to allow for nesting. Accordingly, the rotary indexer 2 can index to a different position to place the center of the wafer beneath the teeth of the relevant grind wheel. In some instances, the center of the wafer is identified and/or aligned to correspond with the teeth, which can allow or simplify the grinding of the entire surface of the wafer. For example, the grind teeth can track through the center of the wafer. Some embodiments are configured to allow the rotary indexer 2 to be positioned to grind only an edge of a stacked or non-stacked wafer using one of the grind wheels or other edge grinder. The rotary indexer movement can also be used in combination with active grinding to step the grinding progressively from the outer diameter to the center of the wafer for stepped or incremental grinding of very hard materials.

Post-Grind Stress Relief: The rotary indexer movement can also be used to move the wafer to a position that allows for post-grind stress relieving by means of polishing, etching or other post grind processing. For example, a polish pad may be mounted to an arm that can be used to polish the wafer while on the chuck. The rotary indexer 2 may provide for oscillation during polishing.

Metrology: Furthermore, rotary indexer movement enables diametrical measurements of chucked wafers by moving the wafer beneath a single (rather than multiple) measuring sensor positioned at the intersection through the center of the wafer. A contact or IR probe can be positioned above the wafer. The contact probe touches the surface of the wafer while the IR probe uses light to measure wafer thickness. Multiple sensors can be used to create a more complete picture, map or shape of the wafer. Sensors, however, can be expensive and take up valuable space. Accordingly, some embodiments limit the number or sensors (e.g., single probe), which can be used in combination with the rotation of the rotary indexer and chuck to allow for the generation of thickness maps using the limited number of sensors.

Additionally or alternatively, more complex polar or Cartesian type measurements can be taken by coordinating rotary indexer and chuck rotations while the wafer is being measured by the single sensor. Some embodiments include a tool control system that allows for coordinated, multi-axis control for chuck and rotary indexer rotations, which enables precise and rapid mapping of the wafer thickness.

Stiffness: The stiffness, and in some instances extreme stiffness in the grind engine is provided to assure and hold accurate wafer positioning during grinding and minimize to the fullest extent vibrations when grinding. This is achieved by placing the rigid rotary indexer on a preloaded sealed cross-roller ring bearing. For example, a cross-roller ring bearing from THK Co. The ring bearing is mounted between the rotary indexer and the lower casting, beneath the grind area. Typically, the rolling elements are sealed to retain the lubricant and can further protect from elements that could contaminate the bearing surface. In some embodiments, the seals are located between inner and outer races of the bearing just inside a face on both sides.

In some embodiments, the work spindle 6 is supported and/or suspended by a pressurized air bearing and held in position by journal and thrust bearings in a housing about a portion of the work spindle. One or more high resolution non-contact sensors and/or sensor gauges can be included in some embodiments to identify a location of the shaft within the housing. Grinding forces are transmitted to the wafer or work piece by the lead screw mechanism feeding the grinding wheel on to the wafer. Force can be calculated by a displacement along a length or central axis of the work spindle shaft within its housing. Feedback is then used to monitor or modify the feed rate to maintain an acceptable grind force against the wafer. In some instances, forces as small as one pound can be detected. The grind spindle linear air bearing can further enable this force resolution.

Figure 11:
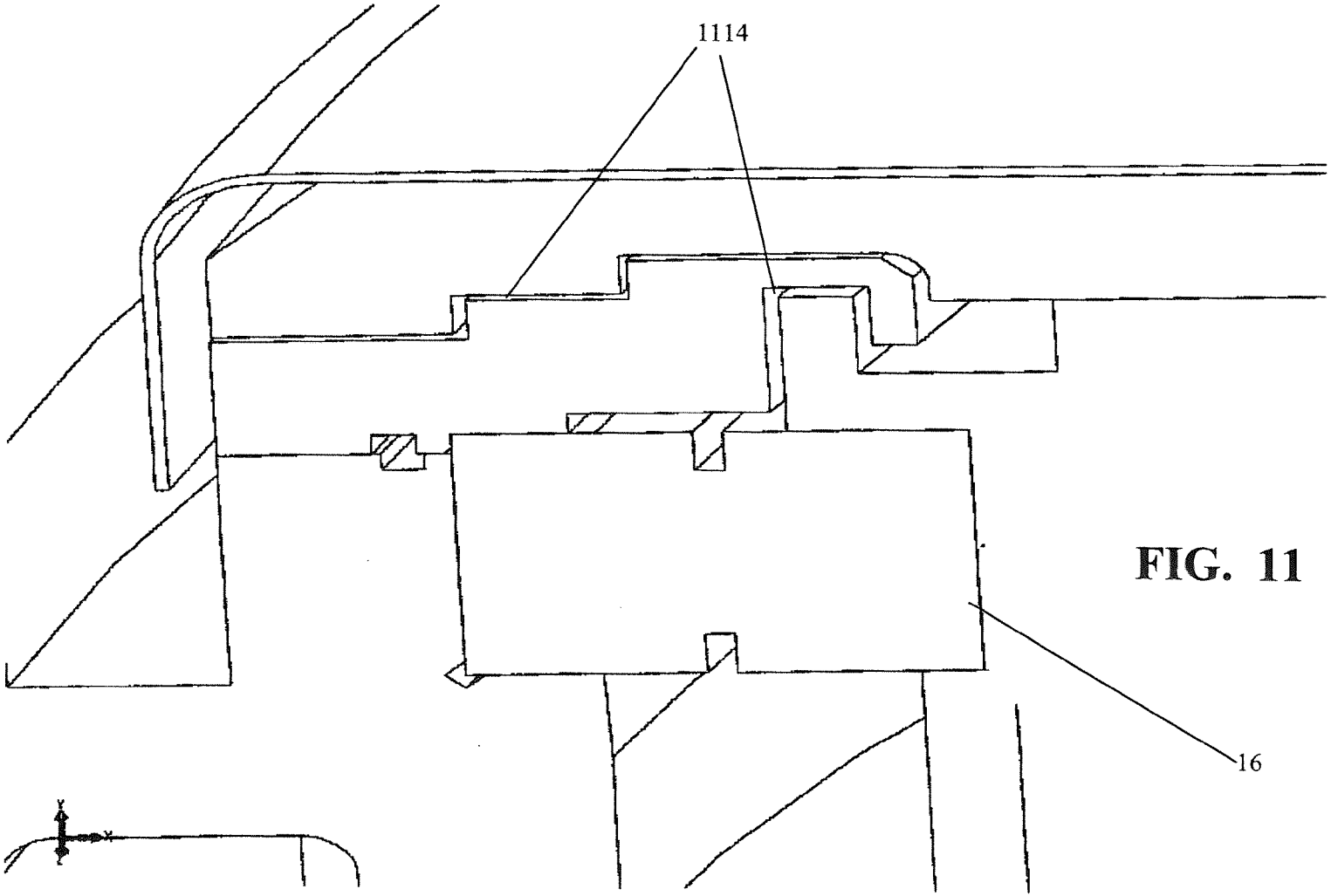
FIG. 11 depicts a cross-sectional, expanded view of a portion of the cross roller ring bearing in accordance with some embodiments.

FIG. 11 depicts a cross-sectional, expanded view of a portion of the cross roller ring bearing 16 in accordance with some embodiments. Above the ring bearing 16 there are several layers of a bearing labyrinth 1114, which in part protect the bearing from fluid and solid contaminates. Work spindle (s) are located inside of the circular cross-roller ring bearing to increase stability when grinding forces are applied. The rotary indexer itself can also be made from a stiff material, such as cast iron.

Throughput: The rotary indexer can accept more than one work spindle to hold and rotate multiple wafers for grinding. In this configuration, wafers can be loaded and unloaded on a chuck while one or more other wafers are being ground on a different chuck, or otherwise being processed (e.g., polished, cleaned, etc.). This increases throughput of the grind engine by allowing wafer handling to occur in parallel with processing. Additionally, multiple grind engines can be utilized and/or incorporated into a single system and used in parallel to further enhance throughput.

Balancing/Center of Gravity: If more than one grind spindle is used, the spindles can be positioned to balance the weight of the rotary indexer assembly (e.g., two spindles that are maintained or limited to about 180 degrees; 3 spindles at about 120 degrees) and maintains a center of gravity as the rotary indexer rotates. In some embodiments, when only one spindle is utilized (e.g. for large diameter wafers), then a Counter Balance Weight (14) may be added. Accordingly, circular-motion indexing does not shift the center of gravity of the rotary indexer (and thereby, the machine) during rotary indexer indexing, and thus, increasing stability to relatively high levels, and reducing affects within the grind engine and to neighboring equipment.

Sealing: As described above, some embodiments employ a circular design for the rotary indexer. Further, the circular design allows for labyrinth shielding of the cross roller bearing, which is highly effective for providing protection of the mechanism against moisture and grinding swarf. This provides smooth motion for the life of the system.

In some embodiments, the Upper Bridge Casting (3) can provide for superior stiffness while still providing access to the grind wheels for maintenance and wheel changes that are typically needed as the abrasive wheel element(s) wear. Access can be provided through a door (17) at the rear of the casting.

An angle of orientation of the rotatable grind wheel (7) to the rotatable wafer on the chuck (5) can determine a shape of the ground wafer. In many implementations the shape is extremely critical to the subsequent building of devices upon the wafer. Accordingly, some embodiments provide methods to determine the optimum grind-spindle angle and a device to mechanize the spindle angle adjustment.

The grind engine is capable of grinding wafers to a thickness of about 100 microns or less. For stacked wafer device manufacture (the semiconductor wafer is stacked via adhesive or other means upon a "carrier" wafer to add stiffness to the combination) the grind engine is configured to grind the top wafer to substantially thinner final thicknesses, such as less than 20 microns. Some embodiments, in achieving precision final thickness over the wafer for stacked wafer applications, employ metrology and software in combination with one or more contact probes (e.g., Heidenhain or Sony model) touching the top surface of the wafer. Additionally or alternatively, an Infrared interferometric sensor can be used that measures the height of the interface between the carrier and the top wafer that is being ground. In some instances, the contact probe and the Infrared sensor can be used in combination.

Figure 12:
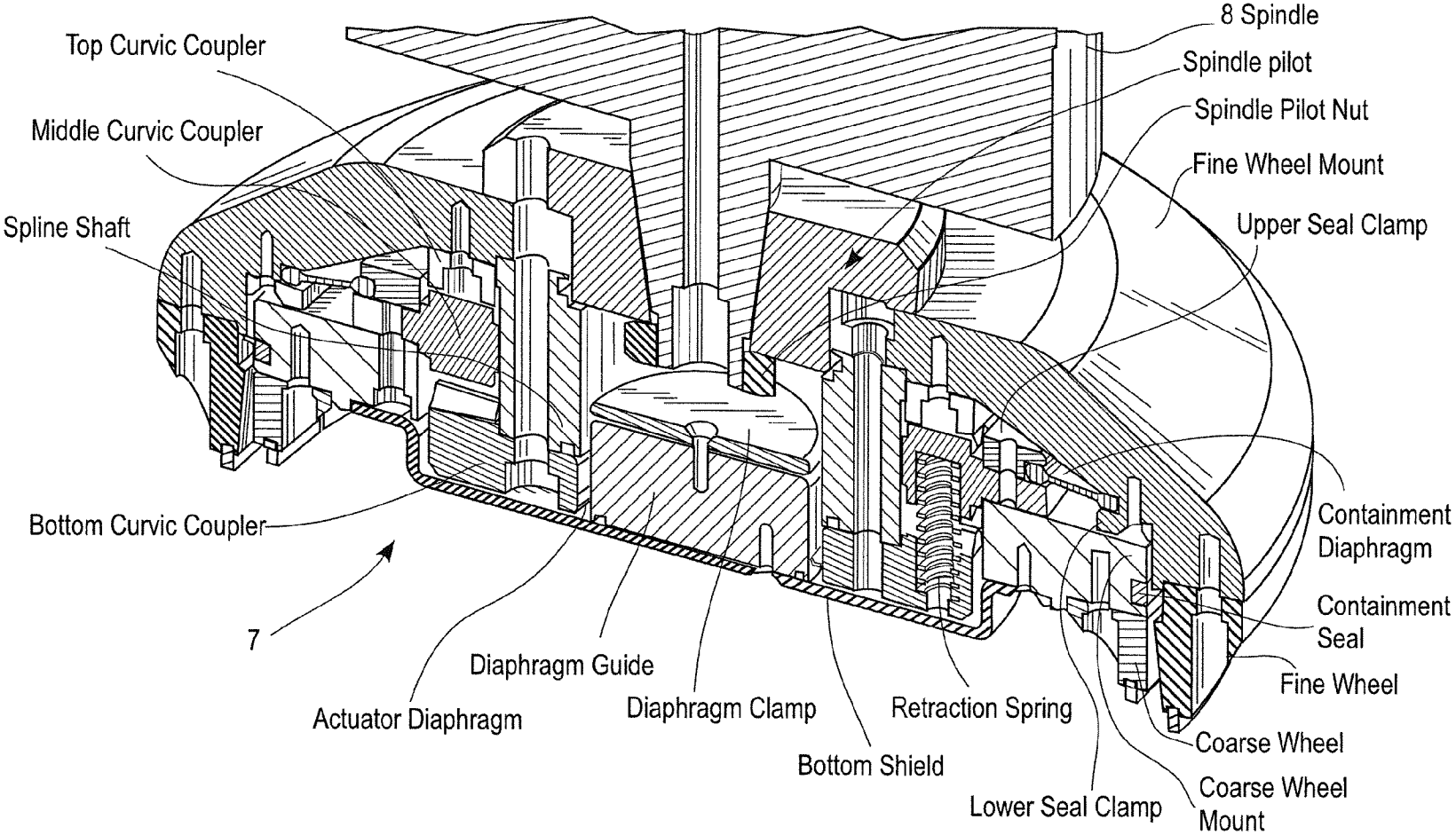
FIG. 12 depicts a simplified cross-sectional view of an extendable grind wheel apparatus in accordance with some embodiments.

FIG. 12 depicts a simplified cross-sectional view of an Extendable Grind wheel apparatus (7) in accordance with some embodiments. The extendable grinding wheel apparatus (7) can be used in some embodiments to allow for both coarse and fine abrasive wheel grinding on the same spindle, without the complexity and cost of a dual-shaft actuator. In some embodiments, the extendable wheel design uses a single air bearing axis, while in others a coaxial air bearing may be employed. Some embodiments utilize some or all of the aspects described in co-pending U.S. patent application Ser. No. 12/287,550, filed Oct. 10, 2008, to Vogtmann et al., and entitled GRINDING APPARATUS HAVING AN EXTENDABLE WHEEL MOUNT, which is incorporated herein by reference in its entirety.

Figure 13:
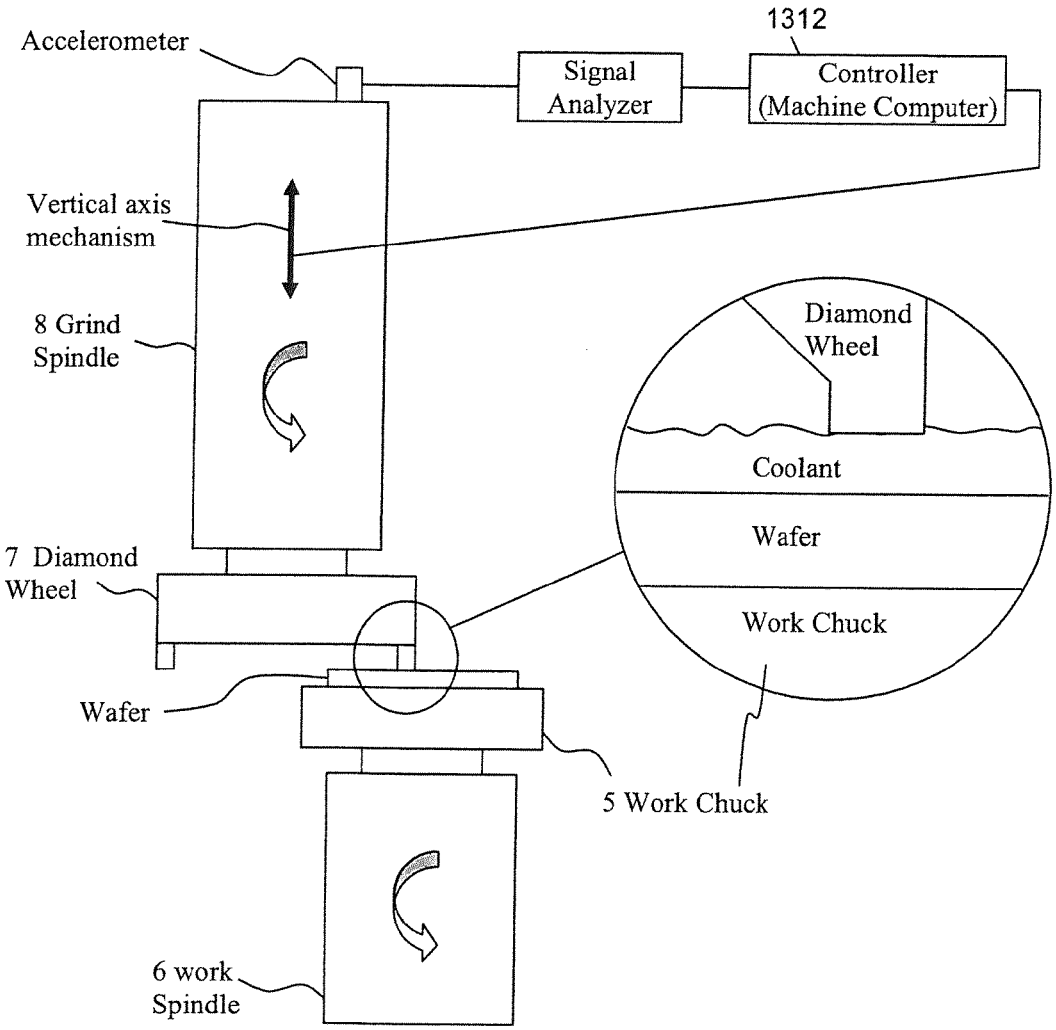
FIG. 13 depicts a simplified block diagram of a spindle assembly cooperated with a controller in tracking relative positioning of the grinding wheel relative to the wafer, in accordance with some embodiments.

FIG. 13 depicts a simplified block diagram of a spindle assembly cooperated with a controller 1312 in tracking relative positioning of the grinding wheel 7 relative to the wafer, in accordance with some embodiments. Throughput can also be increased, in some embodiments by implementing a sensing system to monitor the approach of the grind wheel 7 to the wafer to be ground using a vibration monitor that signals when the grind wheel is very close to the wafer. Since it is difficult to predict exactly when the grind wheel will touch the wafer upon approach, typically grind wheel approach speeds are kept relatively slow. Some present embodiments allow faster grind wheel approach speeds (and throughput) because a controller 1312 (e.g., a grind engine computer) can slow the wheel feed immediately upon receiving a signal from a vibration monitor. This reduces an amount of "air grind" time for each cycle. Additionally or alternatively, some embodiments sense an approaching spindle using motor current and/or chuck spindle forces measurements.

Cleaning the porous vacuum chuck that securely holds the wafer flat for grinding can be important for at least some thin wafer grinding implemented through the grind engine. Some systems clean the chuck with an automated abrasive wheel or a brush mounted to an arm. The abrasive wheel or brush processes, however, may leave small particles of abrasives or of porous chuck particle itself on the surface of the chuck, which then cause an impression or bump on the thin wafer to be ground, so that it is locally over ground. Some embodiments include a sharp blade scraping process, which can be performed after grinding the chuck, in addition to or alternatively to the brush and/or abrasive wheel, so as to dislodge small embedded particles protruding above the surface of the porous chuck.

Figure 14:
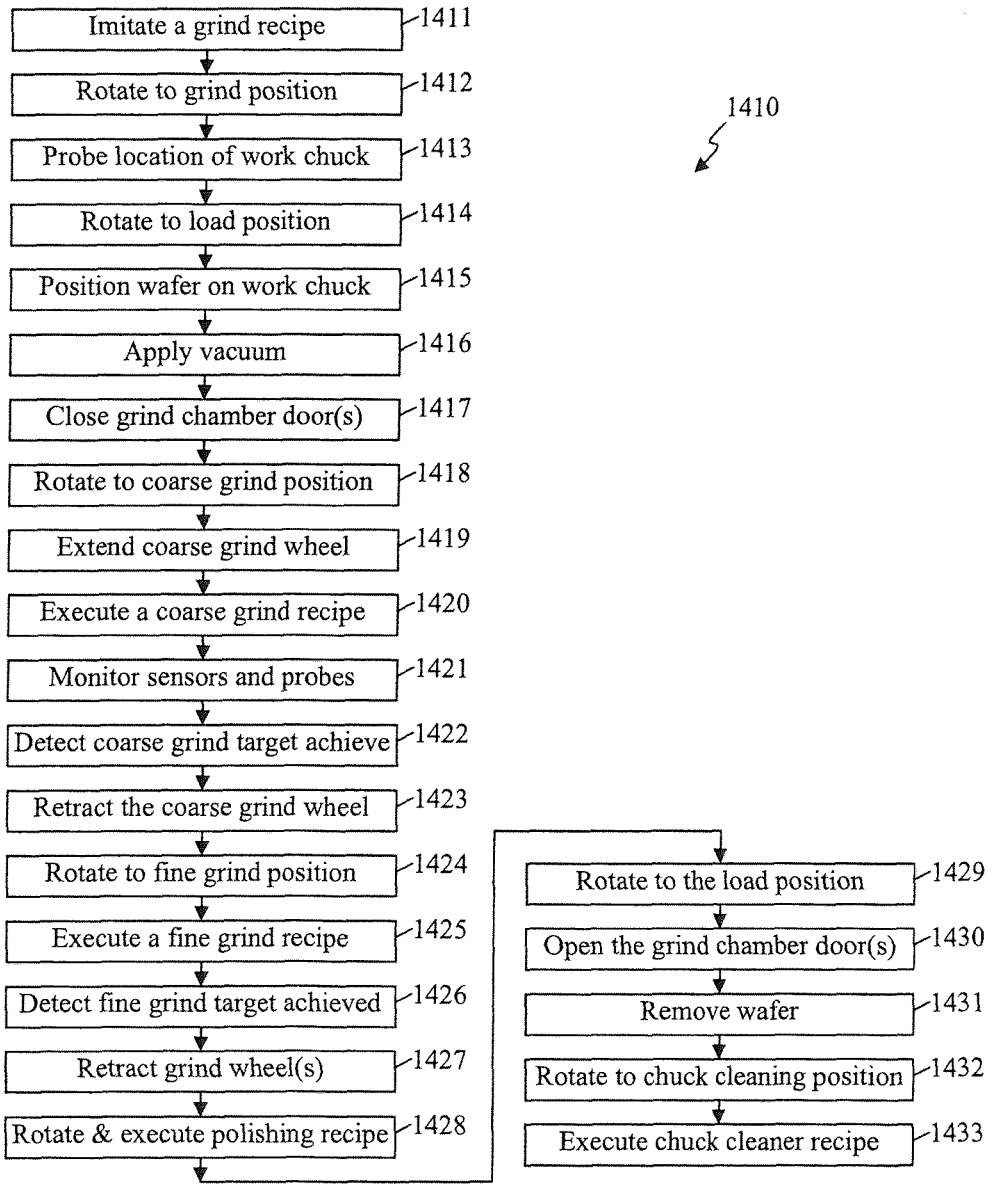
FIG. 14 depicts a simplified process of a grind operation sequence, according to some embodiments.

The grind engine can be utilized and placed in alternative configurations and/or systems, depending upon the product to be manufactured, size and/or the diameter and the material of the wafer, and the precision of the final product required. For example:

The grind engine can be mounted in a simple frame, motors connected to power and control switches, the wafers hand-loaded onto a single grind chuck, the grinding process controlled as described in previous literature (see, for example, U.S. Pat. Nos. 7,118,446 and 7,458,878 by Walsh & Kassir, "Grinding apparatus and Method," which are incorporated herein by reference). FIG. 14 depicts a simplified process of a grind operation sequence, according to some embodiments.

Multiple grind engines (1, 2, or 3) can be combined in an automated-wafer handling tool, where the handling from and to Front Opening Unified Pods (FOUP) (or other types of cassettes) and grinding times are matched so as to achieve comparable through-put.

A multiple grind engine tool can be combined with a stress-relief system to remove sub-surface grinding damage of about 1-3 microns thickness of material before releasing and removing the wafer from the grinding chuck. For some types of processes, stress relief without removing the delicate wafer from the grind chuck is important because it strengthens and increases flexibility of the wafer which may break when released. On-the-chuck stress relieving methods can include the use of a sub-aperture polish arm mechanism having an attached polish pad. The polish process may be with or without a slurry. Alternately stress-relief can be accomplished on the grind chuck using chemical spin-etch methods. The rotary indexer enables the wafer/chuck to move to a position suitable for stress-relief after grinding and for oscillation if desired.

A multiple grind engine tool can be combined with a full-aperture CMP tool to both remove sub-surface damage and to provide final shape to the wafer needed for subsequent process steps. After grind and CMP, the wafer or wafer stack can be cleaned using conventional post-CMP cleaning and/or etch methods before returning to a storage/handling FOUP.

Accordingly, the present embodiments provide methods and systems for use in grinding wafers and/or other such objects. These grinding methods and systems in part improve grind object geometry, increase throughput, and reduce cost of the tool.

Referring back to FIG. 14 depicting a simplified process 1410 of a grind operation sequence, in step 1411, an operator initiates a grind sequence or recipe. In some instances, this includes selecting a grind recipe, loading into the control system of the grind system executing the grind recipe. In step 1412, the rotary indexer 2 is indexed to move the work chuck 5 into a grind position such that the work chuck is positioned proximate the one or more grind wheels. In step 1413, one or more probes and/or sensors are used to determine a relative location of the work chuck 5. In those implementations where the grind system includes two contact probes, both contact probes contact the surface of the work chuck to reference the chuck surface.

In step 1414, the rotary indexer 2 is indexed to move the work chuck 5 and work spindle 6 to a load and/or unload position. In some implementations, the rotary indexer 2 is positioned or rotated to position the work chuck 5 relative to the door 15 of the grind chamber 4 to allow access to (manually or by robot) the work chuck for the placement or removal of a wafer to or from the work chuck. In step 1415, a wafer is placed on the work chuck 5. The placement of the wafer can be manually placed by the operator or technician, or by robot through partial or full automation. In step 1416, a vacuum is applied to and through the work chuck 5 to hold and secure the wafer against the work chuck. In step 1417, the grind chamber door(s) 15 is closed, and in some instances locked. Again, the door closing may be manual or part of the automated operation of the grind device.

In step 1418, the rotary indexer 2 is indexed to move the work chuck 5 and work spindle 6 to the coarse grind position. Typically, the rotary indexer rotates the work chuck such that at least a portion of the wafer supported on the work chuck 5 is aligned with at least a portion the coarse grind wheel secure with the grind spindle 8. In step 1419, the grind spindle 8 is activated to spin the coarse grind wheel according to the grind recipe and extends the coarse grind wheel to contact the wafer. In step 1420, the coarse grind recipe is executed to grind the wafer to a desired thickness. Often, this thickness is defined as a coarse grind thickness to within predefined thresholds. Again, the stiffness, rigidity and precision provided by the grind system allows that threshold to be extremely small, typically limited by the accuracy of the measurement probes and/or sensors of the system. With some current technologies, the thresholds can be as small as tens of micron, and in some instances a micron.

In step 1421, the one or more contract probes and other sensors monitor the thickness and pressures applied to provide feedback to the grind system. For example, a wafer contact probe monitors wafer thickness during grinding, typically in cooperation with a reference measurement of the work chuck surface provided by the work chuck contact probe. Additionally or alternatively, an IR sensor can be used in some embodiments, particularly when grinding a stacked wafer. Work chuck deflection can also be monitored by the chuck contact probe during grind. When the grind forces increase to a pre-defined limit, grinding can be paused and the coarse grind wheel can be automatically dressed. The grinding can then be resumed continuing to monitor the thickness and/or pressures (e.g., for further grind wheel dressing) until a desired wafer thickness and/or surface profile is achieved.

In step 1422, it is detected that the coarse removal target is achieved. In step 1423, the coarse grind wheel is refracted. Some embodiments include optional step 1424, where the rotary indexer 2 is indexed to move the work chuck 5 and wafer to a fine grind position when such movements are desired. In step 1425, the grind system executes the fine grind recipe, which can include steps similar to those of steps 1421-1422. Again, the fine grind is performed until a desired fine grind thickness is achieved to within predefined threshold. Similar to above, the fine grinding may be temporarily interrupted to dress the fine grind wheel, which can be activated in response to detected pressures. In step 1426, it is detected that the fine removal target is achieved.

In step 1427, the fine and/or coarse grind wheel(s) and/or grind spindle 8 are moved to a safe position relative to the wafer and/or work chuck 5. In optional step 1428, the rotary indexer 2 is indexed to move the work chuck 5 to a polish position and a polishing recipe is executed, when the grind system includes a polishing station and/or location. In step 1429, the rotary indexer is indexed to move the work chuck 5 to the load and/or unload position. In step 1430, the grind chamber door(s) are unlocked and opened, when one or more doors are present and/or locked. In step 1431, the wafer is removed from the grind chamber. Again, the removal may be manual or preformed by a robot (e.g., with end effectors).

Some embodiments further include a cleaning station or position. Accordingly, in some instances the process 1410 can include step 1432 where the rotary indexer is indexed to move chuck to chuck cleaning position. In step 1433, a chuck cleaner recipe is executed to clean the chuck 5. Other embodiments may not perform all of these steps, while other embodiments may perform additional steps. Further, some of these steps may be performed at separate devices and/or modules, such as a system cooperating multiple modules as described above and further below.

Further, some embodiments provide compact grinding systems. The compactness can be achieve, at least in part, by the cooperation of the one or more of the rotary indexer 2, the lower base casting 1, the bridge casting 3, the coaxial spindle configuration with dual, nested grind wheels (or single axis spindle combined with the extendable grind wheel apparatus, and other such relevant factors. For example, the use of the rotary indexer 2 contained within the base casting 1 and further configured with dimensions such that the work spindle 6 and work chuck 4 are mounted and rotated by the rotary indexer. The rotary indexer 2 can be configured, in accordance with some embodiments, with a diameter greater than a diameter of the work chuck 5 and a radius that is less than the diameter of the work chuck. In other configurations, the rotary indexer can be configured with a diameter that is greater than a diameter of the work chuck, and with a radius that is about equal to larger than the diameter of the work chuck. For example, in implementations where two work spindles and work chucks are secured with and rotated by the rotary indexer 2, the rotary indexer has a diameter greater than the two work chucks. Further, the rotation of the rotary indexer allows for the carousel movement of the work spindle and chuck into alignment with the one or more grind wheels and/or grind spindle.

The use of the nested, dual grind wheels on a single grind spindle 8 significantly reduced the size by, in part, reducing the number of grind spindles, areas for performing the separate coarse and fine grinding, the separate motors, control, bearings and other structures associated with multiple separate grind spindles. Further, the use of the bridge casting 3 allows for greater support of the grind spindle 8 than can typically be achieved with cantilever style mounting, which can allow reduced structural size and/or material to be used. Additionally, the bridge casting 3 allows for the enclosure of the rotary indexer 2 and grind wheels adding stiffness to the entire grind module with the structure providing a closed loop coupling the grind spindle to the work spindle.

Still further, the use of the rotary indexer design and casting configurations provides enhanced stiffness of the grinding system, and thus allows for greater accuracy in thickness and surface shape while also allowing for very thin grinding. The higher levels of stiffness of the grind engine are provided, at least in part, by the rotary indexer 2 being mounted within the base casting 1 and supported at least near a perimeter of the rotary indexer by the highly stiff cross roller ring bearing 16. The lower base casting 1 fully contains the rotary indexer 2 and the ring bearing 16 providing a stiff base. Further, the rotary indexer 2 and the ring bearing 16 fully contain the one or more work spindles 6 and/or counter balance 14 within their diameters.

Additionally, the cooperation of the base casting 1 and the bridge casting 3 provides a rigid structure that in turn rigidly supports the work spindle 6 and the grind spindle 8. The rotary indexer 2 and cross roller bearing 16 are stiffly mounted in lower base casting 1. The mounting of the bridge casting 6 from the base casting to extend up from the base casting and over at least a portion of the rotary indexer 2 provides for a stiff mounting for the grind spindle 8 relative to the rotary indexer 2 and the work chuck when rotated into a grind position by the rotary indexer.

The present embodiments additionally provide enhanced throughput and/or wafer processing at least through the coaxial grind spindle combined with dual, nested grind wheels and the rotary indexer design. The rotary indexer 2 rotationally positions the work chuck and wafer in relevant locations within the single grind enclosure to achieve multiple operations (e.g., coarse grind, fine grind, polish, chuck cleaning, etc.). This combination minimizes travel and overhead time of the wafer between coarse and fine grind steps as well as polishing, and the cleaning of the work chuck. Further, by securing the two grinding wheels to the same rotational axis allow them to rotate in alignment with each other and further allow for a single alignment mechanism to align both grind wheels at the same time to the work spindle 6. This in part produces a more precise alignment, more compact assembly, faster alignment, and economy of a single alignment mechanism. As described above, some embodiments replace the spindle counterbalance 14 with a second grind spindle. This allows for wafer load/unload on one spindle while the other spindle is preparing for grinding and/or is grinding, which can further reduce overhead time.

Similarly, the grinding system of the present embodiments can provide enhanced processing capabilities. The higher level of stiffness in the grind system, in part, provides for improved process capabilities. For example, the enhanced stiffness allows the ability to grind wafers to an extreme thinness and accuracy of shape. The rigidity of the structure combined with the adjustment screw assemblies provide for the ability for superior alignment of the grind and work spindles. Better alignment allows the wafer to be ground to a more precise shape, and therefore thinner, without the fear of removing too much material in certain areas on the wafer. Superior rigidity also allows the grind module to better maintain spindle alignments, even while subjected to the forces created during grinding.

Improved processing is also provided, at least in part, through other aspects of the grind system. For example, the single spindle alignment for both the coarse and fine grind wheels via use of the coaxial spindle also allows for quicker, easier setup of the grind system. The cooperation of the two measurement probes (one to track the wafer thickness, and the other to track any chuck movement that may have occurred since the wafer was placed on the chuck, e.g., from thermal expansion of the spindle) further improves precision, accuracy and processing. Some implementations additionally or alternatively utilize an IR type probe that further improves the processing and throughput. Again, the IR probe allows for rapid and precise measurements of ground wafer thickness, particularly when performing stacked wafer grinding, instead of only being able to measure the full stack height of the carrier and ground wafer via a contact measurement probe.

The compact rotary indexer 2 further provides improved processing. The use of the rotary indexer 2 in combination with the counter balance (dummy spindle) or the inclusion of a second work spindle 6 balances the rotary indexer and prevents shifting of center of gravity during rotary indexer movement and/or minimizes structural deflections in the grind module, and to adjacent grind modules when cooperated with other grind modules. Further, the rotary indexer 2 allows for positioning, and in some instances oscillation, of the wafer beneath the grind wheels, and/or a post-grind stress relief polish head, pad or other structure. Similarly, the rotary indexer can positions and oscillate the work chuck 5 beneath a chuck cleaning system and/or device. Still further, the rotary indexer 2 can be utilized in some implementations to position and move a wafer beneath a single or multiple wafer measurement devices while the wafer is measured. The combination of rotary indexer and wafer chuck movement can allow for complete measurement of a wafer using only a single sensor.

As described above, the grinding system can be cooperated with one or more other systems and/or engines to provide a cooperative processing tool. Accordingly, in some embodiments, the grind system is provided in a modular design having a compact configuration. This compact configuration, however, still allows the grind system to execute a complete grind process, which can include coarse and fine grind steps and/or edge grinding, if desired, all within the same grind module. Further, the compact design allows the grind system or module to be cooperated or ganged together with one or more other multiple grind modules and/or other types of modules in a single tool. For example, one or more polish modules can be combined with one or more grind modules into a single automated tool. Conversely, the grind module can function all by itself, such as a manual load, laboratory type grinding tool.

Figure 15A:
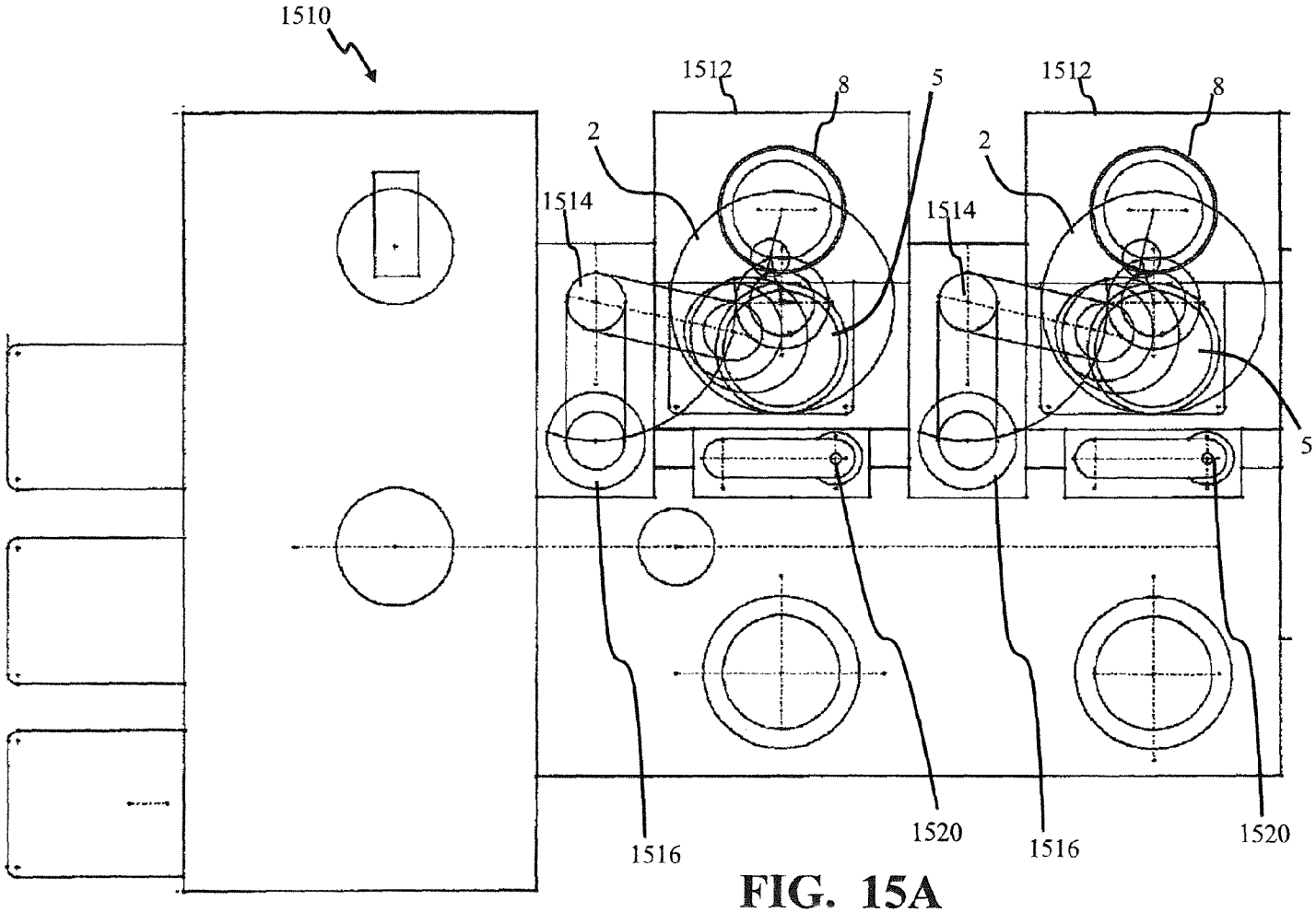
FIG. 15A depicts a simplified, block diagram overhead view over a multiple grind engine tool in accordance with some embodiments.

FIG. 15A depicts a simplified, block diagram overhead view over a multiple grind engine tool 1510 in accordance with some embodiments. The multiple grind engine tool 1510 includes multiple grind systems 1512, which in some instances may be similar to the grinding system of FIG. 1. Cooperated with the grind system 1510 is a polishing system or sub-aperture polish arm mechanism 1514 having an attached polish pad 1516. Further, some embodiments include a work chuck cleaner 1520.

Figure 15B:
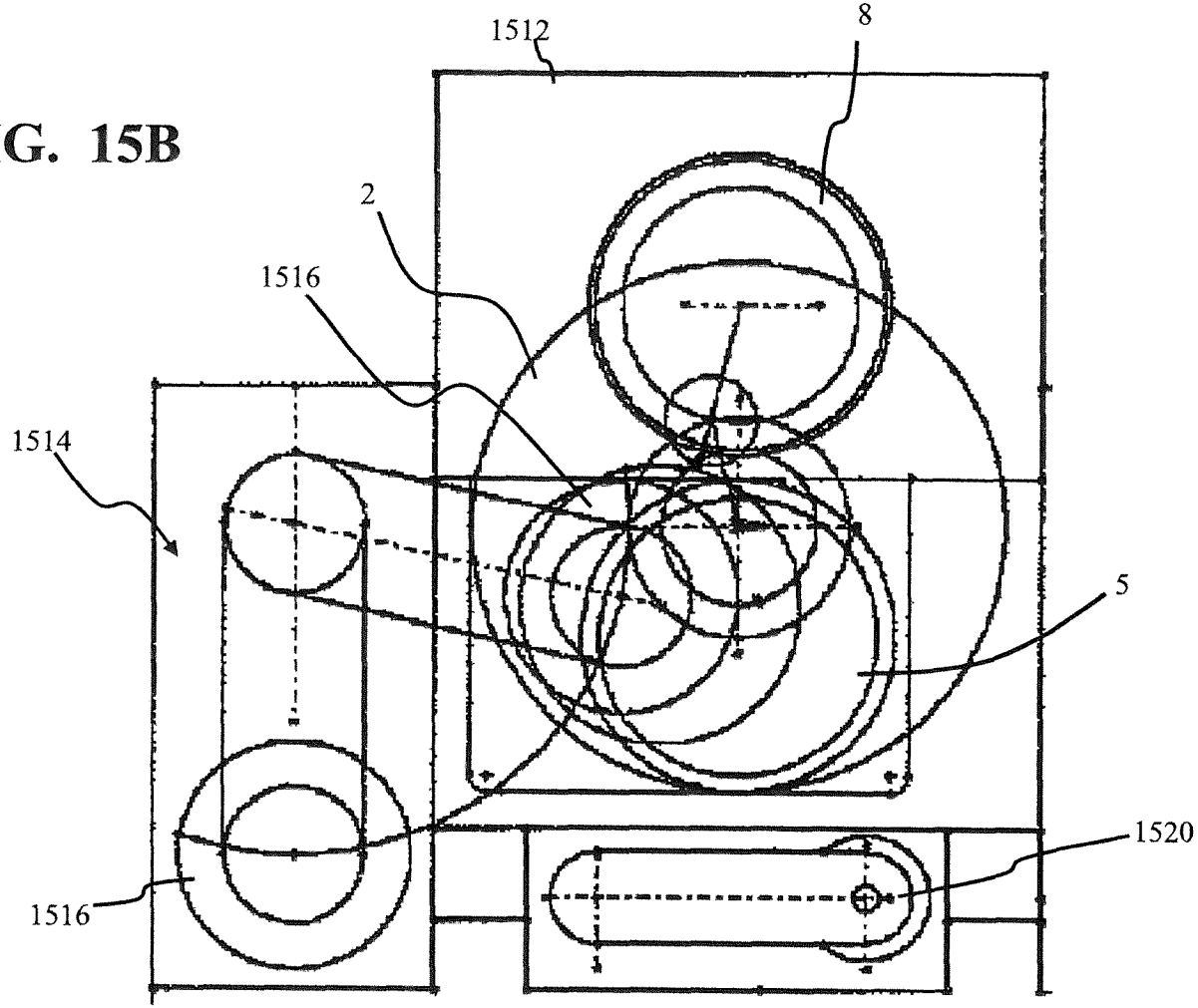
FIG. 15B shows a simplified block diagram overhead view of a grind system cooperated with a polish arm mechanism, in accordance with some embodiments.

FIG. 15B shows a simplified block diagram overhead view of a grind system 1512 cooperated with a polish arm mechanism 1514, which can be incorporated into the multiple grind engine tool 1510 of FIG. 15A in accordance with some embodiments. Referring to FIGS. 15A-B, the polish arm mechanism 1514 includes a polishing pad 1516, which is shown in FIGS. 15A-B*m* in both a parked or idle position to the side of the rotary indexer 2, and rotated into a polish position such that the polishing pad 1516 is over the rotary indexer 2.

Again, the grind system 1512 includes the rotary indexer 2, with the work chuck 5 cooperated with the rotary indexer allowing the rotary indexer to rotate the work chuck 5, and thus a wafer, into a grind position relative to the grind spindle (where the relative position of the grind spindle 8 relative to the work chuck is shown in FIGS. 15A-B by the circular representation) and the grind wheel or wheels. The rotary indexer 2 can further rotate the wafer to the position proximate the polish arm mechanism 1514 allowing the polish arm mechanism 1514 to move the polishing pad 1516 into position to contact and polish the wafer. As described above, in some implementations, the rotary indexer can further be configured to oscillate while the wafer is being polished. Similarly, the rotary indexer 2 can rotate the work chuck 5 into a cleaning position relative to the work chuck cleaner 1520 when the work chuck is to be cleaned. Again, the rotary indexer may be oscillated while the chuck is being cleaned.

It is noted that in some instances other methods and systems may provide thicker wafers. These implementations can use corrective means after grind, such as selective etch and polish methods to modify wafer shape. These subsequent processes add production time and cost to the final product being made on the wafers (i.e. Back-Side Illumination image sensing chips (BSI) image sensors).

Further, some embodiments can provide grinding for Back-Side Illumination camera chips (BSI) and Thru-Silicon Vias (TSV) for 3D stacked wafers are currently being required to achieve more functionality for given chip cross-sectional area. Further, the systems and methods typically provide improved grinding, including grinding thin and/or stacked wafers.

One or more controllers and/or processors are included in the grinding engine and/or cooperated with the grinding engine to provide control over the grinding engine and/or the grinding. Typically the controller receives sensor data and controls the grinding accordingly. The controller or controllers can be implemented through one or more processors, controllers, central processing units, logic, software and the like. Further, in some implementations the controller(s) may provide multiprocessor functionality. Computer and/or processor accessible memory can be included in the controller and/or accessed by the controller. In some embodiments, memory stores executable program code or instructions that when executed by a processor of the controller cause the grinding engine to control the one or more components of the grinding engine and/or perform grinding. Further, the code can cause the implementation of one or more of the processes and/or perform one or more functions such as described herein.

The methods, techniques, systems, devices, services, servers, sources and the like described herein may be utilized, implemented and/or run on many different types of devices and/or systems. These devices and/or systems may be used for any such implementations, in accordance with some embodiments. One or more components of the system may be used for implementing any system, apparatus or device mentioned above or below, or parts of such systems, apparatuses or devices, such as for example any of the above or below mentioned controllers, as well as user interaction system, sensors, feedback, displays, controls, detectors, motors and the like. However, the use of one or more of these systems or any portion thereof is certainly not required.

The memory, which can be accessed by the processors and/or controllers, typically includes one or more processor readable and/or computer readable media accessed by at least the processors and/or controllers, and can include volatile and/or nonvolatile media, such as RAM, ROM, EEPROM, flash memory and/or other memory technology. Further, the memory can be internal to the system; however, the memory can be internal, external or a combination of internal and external memory. The external memory can be substantially any relevant memory such as, but not limited to, one or more of flash memory secure digital (SD) card, universal serial bus (USB) stick or drive, other memory cards, hard drive and other such memory or combinations of such memory. The memory can store code, software, executables, grind recipes, scripts, data, coordinate information, programs, log or history data, user information and the like.

Accordingly, some embodiments provide a processor or computer program product comprising a medium configured to embody a computer program for input to a processor or computer and a computer program embodied in the medium configured to cause the processor or computer to perform or execute steps comprising any one or more of the steps involved in any one or more of the embodiments, methods, processes, approaches, and/or techniques described herein. For example, some embodiments provide one or more computer-readable storage mediums storing one or more computer programs for use with a computer simulation, the one or more computer programs configured to cause a computer and/or processor based system to execute steps comprising: rotating a rotary indexer about a first axis and rotationally orienting a work chuck and work spindle into a load position; applying a vacuum pressure to secure a wafer to the work chuck; rotating the rotary indexer to rotationally orient the work chuck and work spindle into a grind position such that the wafer is at least partially aligned with a coarse grind wheel; activating a grind spindle to apply the coarse grind wheel to the wafer to grind the wafer according to a coarse grind recipe; detecting that the wafer has been ground to a predefined coarse grind thickness; activating the grind spindle to apply a fine grind wheel to grind the wafer according to a fine grind recipe, wherein the fine grind wheel is nested with the coarse grind wheel such that the coarse and fine grind wheels are coaxially aligned about a second axis that is different than the first axis and around which the first and second grind wheels are rotated by the grind spindle; detecting that the wafer has been ground to a predefined fine grind thickness; and rotating, after the detecting that the wafer has been ground to the predefined fine grind thickness, the rotary indexer to the first position such that the work chuck is rotationally orienting into the load position allowing the wafer to be removed.

Other embodiments provide one or more computer-readable storage mediums storing one or more computer programs configured for use with a computer simulation, the one or more computer programs configured to cause a computer and/or processor based system to execute steps comprising: rotating a rotary indexer positioning a work chuck and work spindle secured with the rotary indexer to a load position allowing ready access to position a wafer on the work chuck; rotating the rotary indexer and positioning the work spindle and work chuck to a grind position generally aligned with at least a portion of a grind wheel supported and rotated by a grind spindle; preventing a shifting of a center of gravity of the rotary indexer as the rotary indexer rotates the work chuck by securing a counter balance on the rotary indexer relative to the work spindle.

Some embodiments provide grinding apparatuses comprising: a base casting; a rotary indexer positioned within the base casting, wherein the rotary indexer is configured to rotate within the base casting and about a first axis; a first work spindle secured with the rotary indexer; a first work chuck coupled with the first work spindle, wherein the first work spindle is configured to rotate the first work chuck about a second axis; a bridge casting rigidly secured relative to the base casting, wherein the bridge casting bridges across at least a portion of the rotary indexer and is supported on opposite sides of the rotary indexer; a grind spindle secured with the bridge casting; a first grind wheel cooperated with the grind spindle such that the grind spindle is configured to rotate the first grind wheel, wherein the bridge casting secures the grind spindle such that the first grind wheel is positioned over the rotary indexer to generally align with at least a portion of the first work chuck when the first work spindle is rotated by the rotary indexer into a corresponding position.

Other embodiments provide grinding apparatuses comprising: a grind spindle; a first grind wheel coupled with the grind spindle, wherein the grind spindle is configured to rotate the first grind wheel; a work spindle; a work chuck coupled with the work spindle, wherein the work spindle is configured to rotate the work chuck about a first axis; a rotary indexer positioned relative to the grind spindle, wherein the work spindle is secured with the rotary indexer and wherein the rotary indexer is configured to rotate the work spindle about a second axis that is different than the first axis such that the work chuck is positioned generally in alignment with at least a portion of the first grind wheel; and a ring bearing having a circular, ring configuration, wherein the ring bearing supports the rotary indexer and is configured to aid the rotary indexer in rotating about the second axis, wherein the work spindle is secured with the rotary indexer within an inner diameter of the ring bearing.

Further, some embodiments provide method of wafer grinding, comprising: rotating a rotary indexer about a first axis and rotationally orienting a work chuck and work spindle into a load position; applying a vacuum pressure to secure a wafer to the work chuck; rotating the rotary indexer to rotationally orient the work chuck and work spindle into a grind position such that the wafer is at least partially aligned with a coarse grind wheel; activating a grind spindle to apply the coarse grind wheel to the wafer to grind the wafer according to a coarse grind recipe; detecting that the wafer has been ground to a predefined coarse grind thickness; activating the grind spindle to apply a fine grind wheel to grind the wafer according to a fine grind recipe, wherein the fine grind wheel is nested with the coarse grind wheel such that the coarse and fine grind wheels are coaxially aligned about a second axis that is different than the first axis and around which the first and second grind wheels are rotated by the grind spindle; detecting that the wafer has been ground to a predefined fine grind thickness; and rotating, after the detecting that the wafer has been ground to the predefined fine grind thickness, the rotary indexer to the first position such that the work chuck is rotationally orienting into the load position allowing the wafer to be removed.

While the invention herein disclosed has been described by means of specific embodiments, examples and applications thereof, numerous modifications and variations could be made thereto by those skilled in the art without departing from the scope of the invention set forth in the claims.

What is claimed is:

1. A grinding apparatus, comprising:

a base casting;

a rotary indexer positioned within the base casting, wherein the rotary indexer is configured to rotate within the base casting and about a first axis;

a first work spindle secured with the rotary indexer;

a first work chuck coupled with the first work spindle, wherein the first work spindle is configured to rotate the first work chuck about a second axis;

a bridge casting rigidly secured relative to the base casting, wherein the bridge casting bridges across at least a portion of the rotary indexer and is supported on opposite sides of the rotary indexer structurally forming a closed stiffness loop;

a grind spindle secured with the bridge casting;

a first grind wheel cooperated with the grind spindle such that the grind spindle is configured to rotate the first grind wheel, wherein the bridge casting secures the grind spindle such that the first grind wheel is positioned over the rotary indexer to generally align with at least a portion of the first work chuck when the first work spindle is rotated by the rotary indexer into a corresponding position; and a ring bearing having a circular, ring configuration, wherein the ring bearing is secured between the base casting and the rotary indexer and is configured to aid the rotary indexer in rotating about the first axis relative to the base casting, wherein the first work spindle is positioned within a diameter of the ring bearing.

2. The apparatus of claim 1, further comprising:

a second grind wheel secured with the grind spindle and nested with the first grind wheel such that the first and second grind wheels are coaxially aligned about a third axis around which the first and second grind wheels are rotated by the grind spindle.

3. The apparatus of claim 2, wherein the first grind wheel is extendable along the third axis toward the first work chuck independent of the second grind wheel.

4. A grinding apparatus, comprising:

a base casting;

a rotary indexer positioned within the base casting, wherein the rotary indexer is configured to rotate within the base casting and about a first axis;

a first work spindle secured with the rotary indexer;

a first work chuck coupled with the first work spindle, wherein the first work spindle is configured to rotate the first work chuck about a second axis;

a bridge casting rigidly secured relative to the base casting, wherein the bridge casting bridges across at least a portion of the rotary indexer and is supported on opposite sides of the rotary indexer structurally forming a closed stiffness loop;

a grind spindle secured with the bridge casting;

a first grind wheel cooperated with the grind spindle such that the grind spindle is configured to rotate the first grind wheel, wherein the bridge casting secures the grind spindle such that the first grind wheel is positioned over the rotary indexer to generally align with at least a portion of the first work chuck when the first work spindle is rotated by the rotary indexer into a corresponding position; and a counter balance secured with the rotary indexer such that the counter balance rotates as the rotary indexer rotates, wherein the counter balance balances the rotary indexer relative to at least a weight of the first work spindle and first work chuck preventing shifting of a center of gravity of the rotary indexer as the rotary indexer rotates the first work chuck.

5. A grinding apparatus, comprising:

a base casting;

a rotary indexer positioned within the base casting, wherein the rotary indexer is configured to rotate within the base casting and about a first axis;

a first work spindle secured with the rotary indexer;

a first work chuck coupled with the first work spindle, wherein the first work spindle is configured to rotate the first work chuck about a second axis;

a bridge casting rigidly secured relative to the base casting, wherein the bridge casting bridges across at least a portion of the rotary indexer and is supported on opposite sides of the rotary indexer structurally forming a closed stiffness loop;

a grind spindle secured with the bridge casting;

a first grind wheel cooperated with the grind spindle such that the grind spindle is configured to rotate the first grind wheel, wherein the bridge casting secures the grind spindle such that the first grind wheel is positioned over the rotary indexer to generally align with at least a portion of the first work chuck when the first work spindle is rotated by the rotary indexer into a corresponding position; and a polishing pad positioned relative to the base casting, wherein the rotary indexer is configured to rotate the first work chuck carrying a wafer into a position proximate the polishing pad such that the polishing pad is configured to be applied to the wafer in polishing the wafer.

6. The apparatus of claim 5, wherein the rotary indexer is further configured to rotationally oscillate the first work chuck about the first axis and relative to the polishing pad while the polishing pad is polishing the wafer.

7. The apparatus of claim 1, further comprising:

a cleaning device positioned relative to the rotary indexer, wherein the rotary indexer is configured to rotate the work chuck into a position proximate the cleaning device such that the cleaning device is configured to clean the work chuck.

8. A grinding apparatus, comprising:

a base casting;

a rotary indexer positioned within the base casting, wherein the rotary indexer is configured to rotate within the base casting and about a first axis;

a first work spindle secured with the rotary indexer;

a first work chuck coupled with the first work spindle, wherein the first work spindle is configured to rotate the first work chuck about a second axis;

a bridge casting rigidly secured relative to the base casting, wherein the bridge casting bridges across at least a portion of the rotary indexer and is supported on opposite sides of the rotary indexer structurally forming a closed stiffness loop;

a grind spindle secured with the bridge casting;

a first grind wheel cooperated with the grind spindle such that the grind spindle is configured to rotate the first grind wheel, wherein the bridge casting secures the grind spindle such that the first grind wheel is positioned over the rotary indexer to generally align with at least a portion of the first work chuck when the first work spindle is rotated by the rotary indexer into a corresponding position; and a measuring sensor positioned relative to the rotary indexer, wherein the measurement sensor is configured to be used in cooperation with rotation of the rotary indexer and the first work chuck in providing properties of a wafer carried by the first work chuck.

9. The apparatus of claim 1, further comprising:

at least one sensor probe configured to provide information tracking a surface of the wafer during grinding such that a thickness of the wafer during grinding is determined relative a position of the first work chuck.

10. The apparatus of claim 9, further comprising:

an infrared (IR) probe positioned relative to a surface of the wafer during grinding, wherein the IR probe is configured to provide information corresponding to a thickness of the wafer during grinding.

11. The apparatus of claim 1, further comprising:

an air bearing sleeve that extends along a portion of a length of the grind spindle, wherein the air bearing sleeve provides an air bearing around the portion of the length of the grind spindle configured to firmly support the grind spindle resisting moment load deflections due to grind forces while allowing axial movement of the grind spindle relative to the air bearing sleeve.

12. A grinding apparatus, comprising:

a base casting;

a rotary indexer positioned within the base casting, wherein the rotary indexer is configured to rotate within the base casting and about a first axis;

a first work spindle secured with the rotary indexer;

a first work chuck coupled with the first work spindle, wherein the first work spindle is configured to rotate the first work chuck about a second axis;

a bridge casting rigidly secured relative to the base casting, wherein the bridge casting bridges across at least a portion of the rotary indexer and is supported on opposite sides of the rotary indexer structurally forming a closed stiffness loop;

a grind spindle secured with the bridge casting;

a first grind wheel cooperated with the grind spindle such that the grind spindle is configured to rotate the first grind wheel, wherein the bridge casting secures the grind spindle such that the first grind wheel is positioned over the rotary indexer to generally align with at least a portion of the first work chuck when the first work spindle is rotated by the rotary indexer into a corresponding position;

a work spindle air bearing housing secured relative to the work spindle establishing an air bearing supporting the work spindle; and one or more non-contact position sensors secured proximate the work spindle, wherein the one or more non-contact sensors are configured to measure a displacement of the work spindle proportional to a force applied by the first grind wheel on the wafer.

13. A method of wafer grinding, the method comprising:

rotating a rotary indexer about a first axis and rotationally orienting a work chuck and work spindle into a load position;

applying a vacuum pressure to secure a wafer to the work chuck;

rotating the rotary indexer to rotationally orient the work chuck and work spindle into a grind position such that the wafer is at least partially aligned with a coarse grind wheel;

activating a grind spindle to apply the coarse grind wheel to the wafer to grind the wafer according to a coarse grind recipe;

detecting that the wafer has been ground to a predefined coarse grind thickness;

activating the grind spindle to apply a fine grind wheel to grind the wafer according to a fine grind recipe, wherein the fine grind wheel is nested with the coarse grind wheel such that the coarse and fine grind wheels are coaxially aligned about a second axis that is different than the first axis and around which the first and second grind wheels are rotated by the grind spindle;

detecting that the wafer has been ground to a predefined fine grind thickness;

rotating, after the detecting that the wafer has been ground to the predefined fine grind thickness, the rotary indexer to the first position such that the work chuck is rotationally orienting into the load position allowing the wafer to be removed;

applying a first sensor probe to a surface of the wafer chuck carrying the wafer and tracking chuck surface position information of the surface of the work chuck during grinding of a wafer;

applying a second sensor probe to a surface of the wafer being ground and tracking wafer surface information; and determining a thickness of the wafer during the grinding as a function of the wafer surface information relative to the chuck surface position information.

14. The method of claim 13, wherein the activating the grind spindle to apply the coarse grind wheel to the wafer comprises:

extending the coarse grind wheel in a first direction along the second axis and toward the wafer, applying force in the first direction as the coarse grind wheel is in contact with the wafer, and retracting the coarse grind wheel along the second axis opposite the first direction; and wherein the activating the grind spindle to apply the fine grind wheel to grind the wafer comprises:

feeding the fine grind wheel in the first direction along the second axis and toward the wafer, applying force in the first direction as the fine grind wheel is in contact with the wafer, and retracting the coarse grind wheel along the second axis opposite the first direction.

15. The method of claim 13, further comprising:

rotating the rotary indexer into the grind position prior to grinding the wafer;

aligning the grind spindle relative to the wafer providing alignment of both the coarse grind wheel and the fine grind wheel through a single grind spindle alignment.

16. A method of wafer grinding, the method comprising:

rotating a rotary indexer about a first axis and rotationally orienting a work chuck and work spindle into a load position;

applying a vacuum pressure to secure a wafer to the work chuck;

rotating the rotary indexer to rotationally orient the work chuck and work spindle into a grind position such that the wafer is at least partially aligned with a coarse grind wheel;

activating a grind spindle to apply the coarse grind wheel to the wafer to grind the wafer according to a coarse grind recipe;

detecting that the wafer has been ground to a predefined coarse grind thickness;

activating the grind spindle to apply a fine grind wheel to grind the wafer according to a fine grind recipe, wherein the fine grind wheel is nested with the coarse grind wheel such that the coarse and fine grind wheels are coaxially aligned about a second axis that is different than the first axis and around which the first and second grind wheels are rotated by the grind spindle;

detecting that the wafer has been ground to a predefined fine grind thickness; and rotating, after the detecting that the wafer has been ground to the predefined fine grind thickness, the rotary indexer to the first position such that the work chuck is rotationally orienting into the load position allowing the wafer to be removed;

rotating the rotary indexer into the grind position prior to grinding the wafer; and aligning the grind spindle relative to the wafer providing alignment of both the coarse grind wheel and the fine grind wheel through a single grind spindle alignment;

wherein the aligning the grind spindle through the single grind spindle alignment comprises adjusting one or more grind spindle adjustment screw assemblies secured with the grind spindle such that adjustments of the one or more grind spindle adjustment screw assemblies cause adjustments to pitch and yaw of the grind spindle relative to the wafer.

17. A method of wafer grinding, the method comprising:

rotating a rotary indexer about a first axis and rotationally orienting a work chuck and work spindle into a load position;

applying a vacuum pressure to secure a wafer to the work chuck;

rotating the rotary indexer to rotationally orient the work chuck and work spindle into a grind position such that the wafer is at least partially aligned with a coarse grind wheel;

activating a grind spindle to apply the coarse grind wheel to the wafer to grind the wafer according to a coarse grind recipe;

detecting that the wafer has been ground to a predefined coarse grind thickness;

activating the grind spindle to apply a fine grind wheel to grind the wafer according to a fine grind recipe, wherein the fine grind wheel is nested with the coarse grind wheel such that the coarse and fine grind wheels are coaxially aligned about a second axis that is different than the first axis and around which the first and second grind wheels are rotated by the grind spindle;

detecting that the wafer has been ground to a predefined fine grind thickness; and rotating, after the detecting that the wafer has been ground to the predefined fine grind thickness, the rotary indexer to the first position such that the work chuck is rotationally orienting into the load position allowing the wafer to be removed;

positioning the rotary indexer within a base casting;

supporting the rotary indexer by a ring bearing having a circular, ring configuration positioned proximate a periphery of the rotary indexer; and supporting the ring bearing and the rotary indexer by the base casting providing an increase in rigidity and aiding the rotary indexer in rotating about the first axis relative to the base casting.

18. The method of claim 17, further comprising:
securing the work spindle with the rotary indexer such that the work spindle is positioned within a diameter of the ring bearing.

19. The method of claim 13, further comprising:
securing a bridge casting relative to the rotary indexer such that the bridge casting extends across at least a portion of the rotary indexer forming closed stiffness loop;
securing the grind spindle with the bridge casting and the bridge casting supporting the grind spindle such that the coarse grind wheel is opposite the rotary indexer and oriented to be applied to the wafer.

20. A method of wafer grinding, the method comprising:
rotating a rotary indexer about a first axis and rotationally orienting a work chuck and work spindle into a load position;
applying a vacuum pressure to secure a wafer to the work chuck;
rotating the rotary indexer to rotationally orient the work chuck and work spindle into a grind position such that the wafer is at least partially aligned with a coarse grind wheel;
activating a grind spindle to apply the coarse grind wheel to the wafer to grind the wafer according to a coarse grind recipe;
detecting that the wafer has been ground to a predefined coarse grind thickness;
activating the grind spindle to apply a fine grind wheel to grind the wafer according to a fine grind recipe, wherein the fine grind wheel is nested with the coarse grind wheel such that the coarse and fine grind wheels are coaxially aligned about a second axis that is different than the first axis and around which the first and second grind wheels are rotated by the grind spindle;
detecting that the wafer has been ground to a predefined fine grind thickness;
rotating, after the detecting that the wafer has been ground to the predefined fine grind thickness, the rotary indexer to the first position such that the work chuck is rotationally orienting into the load position allowing the wafer to be removed;
securing a bridge casting relative to the rotary indexer such that the bridge casting extends across at least a portion of the rotary indexer forming closed stiffness loop;
securing the grind spindle with the bridge casting and the bridge casting supporting the grind spindle such that the coarse grind wheel is opposite the rotary indexer and oriented to be applied to the wafer;
rotating the rotary indexer to a polish position; and
activating a polishing pad to polish the wafer.

21. The method of claim 20, further comprising:
oscillating the rotary indexer while in the polish position and while polishing the wafer.

22. A method of wafer grinding, the method comprising:
rotating a rotary indexer about a first axis and rotationally orienting a work chuck and work spindle into a load position;
applying a vacuum pressure to secure a wafer to the work chuck;
rotating the rotary indexer to rotationally orient the work chuck and work spindle into a grind position such that the wafer is at least partially aligned with a coarse grind wheel;
activating a grind spindle to apply the coarse grind wheel to the wafer to grind the wafer according to a coarse grind recipe;
detecting that the wafer has been ground to a predefined coarse grind thickness;
activating the grind spindle to apply a fine grind wheel to grind the wafer according to a fine grind recipe, wherein the fine grind wheel is nested with the coarse grind wheel such that the coarse and fine grind wheels are coaxially aligned about a second axis that is different than the first axis and around which the first and second grind wheels are rotated by the grind spindle;
detecting that the wafer has been ground to a predefined fine grind thickness;
rotating, after the detecting that the wafer has been ground to the predefined fine grind thickness, the rotary indexer to the first position such that the work chuck is rotationally orienting into the load position allowing the wafer to be removed;
securing a bridge casting relative to the rotary indexer such that the bridge casting extends across at least a portion of the rotary indexer forming closed stiffness loop;
securing the grind spindle with the bridge casting and the bridge casting supporting the grind spindle such that the coarse grind wheel is opposite the rotary indexer and oriented to be applied to the wafer;
rotating the rotary indexer to the load position;
deactivating the vacuum pressure allowing the wafer to be removed;
rotating the rotary indexer to a chuck cleaning position; and
implementing a chuck cleaning recipe comprising oscillating the rotary indexer during at least a portion of implementing the cleaning recipe.

23. A method of grinding a wafer, the method comprising:
rotating a rotary indexer positioning a work chuck and work spindle secured with the rotary indexer to a load position allowing ready access to position a wafer on the work chuck;
rotating the rotary indexer and positioning the work spindle and work chuck to a grind position generally aligned with at least a portion of a grind wheel supported and rotated by a grind spindle;
preventing a shifting of a center of gravity of the rotary indexer as the rotary indexer rotates the work chuck by securing a counter balance on the rotary indexer relative to the work spindle.

24. The method of claim 23, further comprising:
enhancing a rigidity of the rotary indexer comprising:
supporting the rotary indexer with a ring bearing positioned proximate a perimeter of the rotary indexer;
securing the work spindle with the rotary indexer such that the work spindle is positioned within and extends through a diameter of the ring bearing;
positioning the rotary indexer within a base casting;
supporting the ring bearing and the rotary indexer by the base casting such that the ring bearing is configured to aid in allowing the rotary indexer to rotate relative to the base casting;
securing a bridge casting with the base casting such that the bridge casting extends from the base casting and the rotary indexer and further extends over, separate from and across at least a portion of the rotary indexer forming a closed stiffness loop; and
securing the grind spindle with the bridge casting such that grind wheel is positioned relative to the rotary indexer.

25. The method of claim 13, further comprising:
securing a bridge casting relative to the rotary indexer such that the bridge casting bridges across and extends over at least a portion of the rotary indexer structurally forming a closed stiffness loop; and securing the grind spindle with the bridge casting such that grind wheel is positioned relative to the rotary indexer.

26. The method of claim 16, further comprising:

securing a bridge casting relative to the rotary indexer such that the bridge casting bridges across and extends over at least a portion of the rotary indexer structurally forming a closed stiffness loop; and securing the grind spindle with the bridge casting such that grind wheel is positioned relative to the rotary indexer.

* * * * *